US012600448B1

(12) United States Patent
Powers

(10) Patent No.: US 12,600,448 B1
(45) Date of Patent: Apr. 14, 2026

(54) ENHANCED PERFORMANCE PARALLEL LOOP BLADE PROPELLERS

(71) Applicant: Charles S Powers, Shreveport, LA (US)

(72) Inventor: Charles S Powers, Shreveport, LA (US)

( * ) Notice: Subject to any disclaimer, the term of this patent is extended or adjusted under 35 U.S.C. 154(b) by 0 days.

(21) Appl. No.: 19/178,979

(22) Filed: Apr. 15, 2025

Related U.S. Application Data

(60) Provisional application No. 63/633,886, filed on Apr. 15, 2024.

(51) Int. Cl.
*B63H 1/26* (2006.01)
*B63H 1/20* (2006.01)
*B63H 5/10* (2006.01)

(52) U.S. Cl.
CPC ..... *B63H 1/265* (2013.01); *B63H 1/20* (2013.01); *B63H 5/10* (2013.01); *B63H 2005/106* (2013.01)

(58) Field of Classification Search
CPC . B63H 1/265; B63H 1/20; B63H 5/10; B63H 2005/106; B63H 1/26
See application file for complete search history.

(56) References Cited

U.S. PATENT DOCUMENTS

| | | | |
|---|---|---|---|
| 6,914 | A | 11/1849 | Patch |
| 10,104 | A | 10/1853 | Tress |
| 46,004 | A | 1/1865 | Jacob |
| 50,714 | A | 10/1865 | Jacob |
| 193,989 | A | 8/1877 | Nelon |
| 283,592 | A | 8/1883 | Folmer |
| 338,040 | A | 3/1886 | Daniels |
| 467,322 | A | 1/1892 | Myers |
| 467,824 | A | 1/1892 | Myers et al. |
| 547,210 | A | 10/1895 | Haussmann |
| 1,366,836 | A | 1/1921 | Rae |
| 3,504,990 | A | 4/1970 | Sugden |
| 6,736,600 | B1 | 5/2004 | Bannasch |
| 9,926,058 | B2 | 3/2018 | Sharrow |
| D974,267 | S | 1/2023 | Sharrow |
| D974,268 | S | 1/2023 | Sharrow |
| D974,269 | S | 1/2023 | Sharrow |
| D974,270 | S | 1/2023 | Sharrow |

(Continued)

FOREIGN PATENT DOCUMENTS

WO WO-2004074089 A1 * 9/2004 ..... B63H 5/10

*Primary Examiner* — Nathaniel E Wiehe
*Assistant Examiner* — Maxime M Adjagbe
(74) *Attorney, Agent, or Firm* — R. Keith Harrison

(57) ABSTRACT

Enhanced performance parallel loop blade propellers may include a propeller hub having a fore hub end and an aft hub end. A plurality of looped blade pairs may extend from the propeller hub in spaced-apart relationship to each other. Each of the looped blade pairs may include a fore blade which extends from the propeller hub proximate the fore hub end. An aft blade may extend from the propeller hub proximate the aft hub end. The aft blade may be disposed generally within a common blade pitch plane as the fore blade in an adjacent one of the looped blade pairs. Accordingly, the fore blade and the aft blade of each corresponding looped blade pair may be disposed in generally parallel relationship to each other. A blade bridge may extend from the fore blade to the aft blade in each looped blade pair.

28 Claims, 33 Drawing Sheets

(56) References Cited

U.S. PATENT DOCUMENTS

| | | | | |
|---|---|---|---|---|
| 11,603,184 | B2 | 3/2023 | Sharrow | |
| D987,545 | S | 5/2023 | Sharrow | |
| D988,967 | S | 6/2023 | Sharrow | |
| D1,011,257 | S | 1/2024 | Sharrow | |
| D1,013,605 | S | 2/2024 | Sharrow | |
| D1,014,390 | S | 2/2024 | Sharrow | |
| D1,014,391 | S | 2/2024 | Sharrow | |
| 2022/0340247 | A1* | 10/2022 | Sharrow | B63H 5/10 |

* cited by examiner

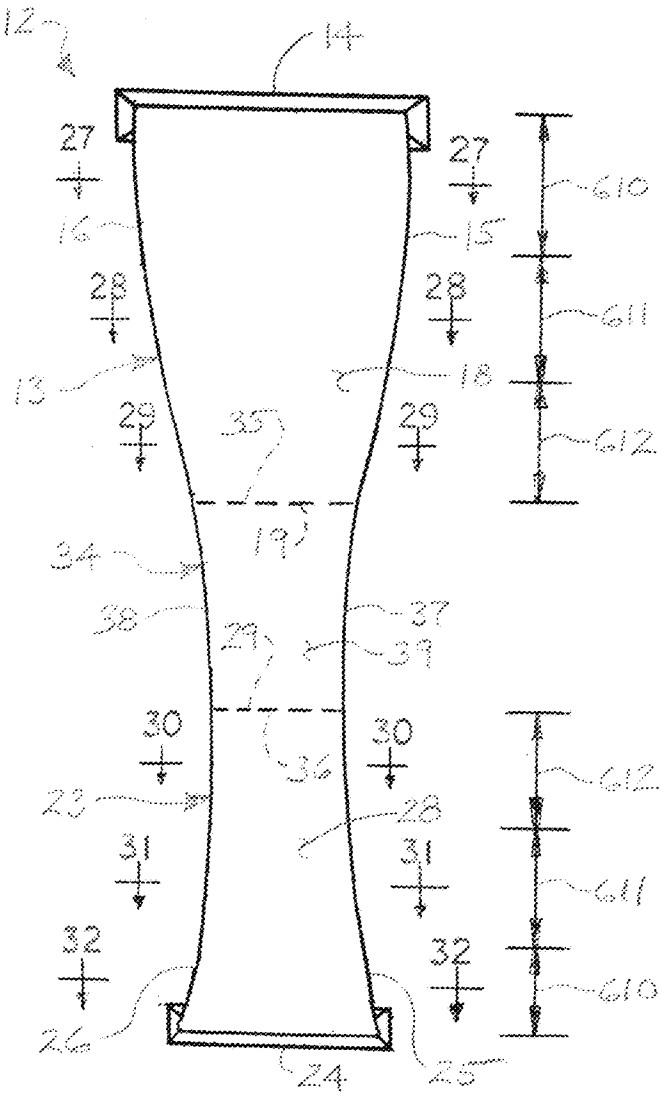
FIG. 26
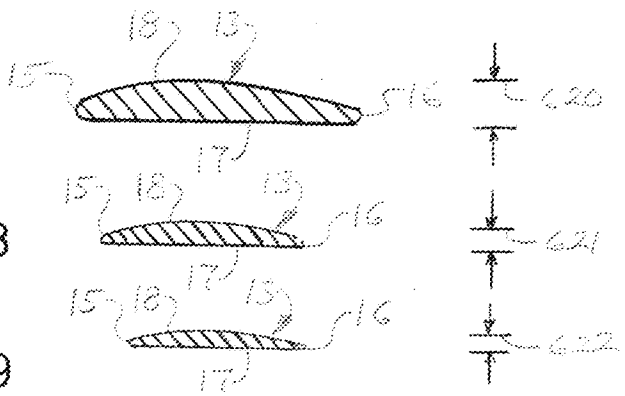
FIG. 27
FIG. 28
FIG. 29
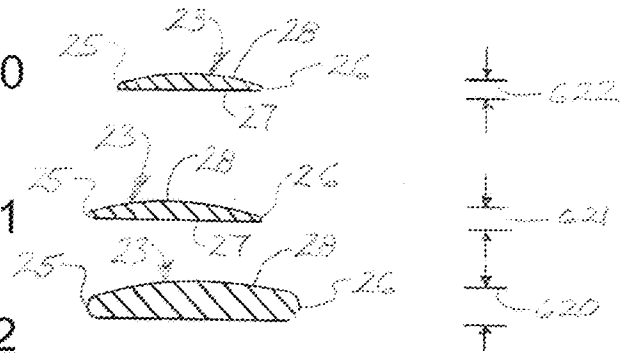
FIG. 30
FIG. 31
FIG. 32

ENHANCED PERFORMANCE PARALLEL LOOP BLADE PROPELLERS

CROSS REFERENCE TO RELATED APPLICATIONS

This application claims the benefit of U.S. provisional application No. 63/633,886, filed Apr. 15, 2024, and entitled ENHANCED PERFORMANCE PARALLEL LOOP BLADE PROPELLERS, which provisional application is hereby incorporated by reference herein in its entirety.

FIELD

Illustrative embodiments relate to fluid movers such as marine propellers. More particularly, illustrative embodiments of the disclosure relate to enhanced performance parallel loop blade propellers including a propeller hub and multiple looped blade pairs each having a fore blade, an aft blade and a blade bridge connecting the fore blade and the aft blade.

SUMMARY

Illustrative embodiments of the disclosure are directed to enhanced performance parallel loop blade propellers. An illustrative embodiment of the propellers may include a propeller hub having a fore hub end and an aft hub end. A plurality of looped blade pairs may extend from the propeller hub in spaced-apart relationship to each other. Each of the looped blade pairs may include a fore blade which extends from the propeller hub proximate the fore hub end. An aft blade may extend from the propeller hub proximate the aft hub end. The aft blade may be disposed generally within a common blade pitch plane as the fore blade in an adjacent one of the looped blade pairs. Accordingly, the fore blade and the aft blade of each corresponding one of the plurality of looped blade pairs may be disposed in generally parallel relationship to each other. A blade bridge may extend from the fore blade to the aft blade in each looped blade pair.

In some embodiments, the enhanced performance parallel loop blade propellers may include a propeller hub having a fore hub end and an aft hub end. A plurality of looped blade pairs may extend from the propeller hub in spaced-apart relationship to each other. Each looped blade pair may include a fore blade extending from the propeller hub proximate the fore hub end. An aft blade may extend from the propeller hub proximate the aft hub end. The aft blade may be disposed generally within a common blade pitch plane as the fore blade in an adjacent blade pair. Accordingly, the fore blade and the aft blade of each corresponding looped blade pair may be disposed in generally parallel relationship to each other. A blade bridge may extend from the fore blade to the aft blade. A fore blade root of the fore blade and an aft blade root of the aft blade may be separated from each other by a blade root spacing distance less than or generally equal to a blade root chord width of the fore blade root. In some embodiments, the enhanced performance parallel loop blade propellers may include a fore propeller and an aft propeller configured to counter rotate with respect to each other. Each of the fore propeller and the aft propeller may include a propeller hub having a fore hub end and an aft hub end. A plurality of looped blade pairs may extend from the propeller hub in spaced-apart relationship to each other. Each looped blade pair may include a fore blade extending from the propeller hub proximate the fore hub end. An aft blade may extend from the propeller hub proximate the aft hub end. The aft blade may be disposed generally within a common blade pitch plane as the fore blade in an adjacent looped blade pair. Accordingly, the fore blade and the aft blade of each corresponding looped blade pair may be disposed in generally parallel relationship to each other. A blade bridge may extend from the fore blade to the aft blade. A fore blade root of the fore blade and an aft blade root of the aft blade may be separated from each other by a blade root spacing distance less than or generally equal to a blade root chord width of the fore blade root.

BRIEF DESCRIPTION OF THE DRAWINGS

Illustrative embodiments of the disclosure will now be described, by way of example, with reference to the accompanying drawings, in which:

FIG. 26 is a two-dimensional planar exterior view of a looped blade pair of an illustrative embodiment of the enhanced performance parallel loop blade propellers in which the fore blade and the aft blade of each looped blade pair have various foil profiles including profiles in which the point of maximum thickness in each blade is apportioned to the proximal blade segment, the middle blade segment or the distal blade segment of each blade;

FIGS. 27-29 are cross-sectional views, taken along section lines 27-27, 28-28 and 29-29, respectively, in FIG. 26, showing the maximum thickness as apportioned to the proximal blade segment in the fore blade of each looped blade pair according to some embodiments of the enhanced performance parallel loop blade propellers;

FIGS. 30-32 are cross-sectional views, taken along section lines 30-30, 31-31 and 32-32, respectively, in FIG. 26, showing the maximum thickness as apportioned to the proximal blade segment in the aft blade of each looped blade pair according to some embodiments of the enhanced performance parallel loop blade propellers;

DETAILED DESCRIPTION

Figure 1:
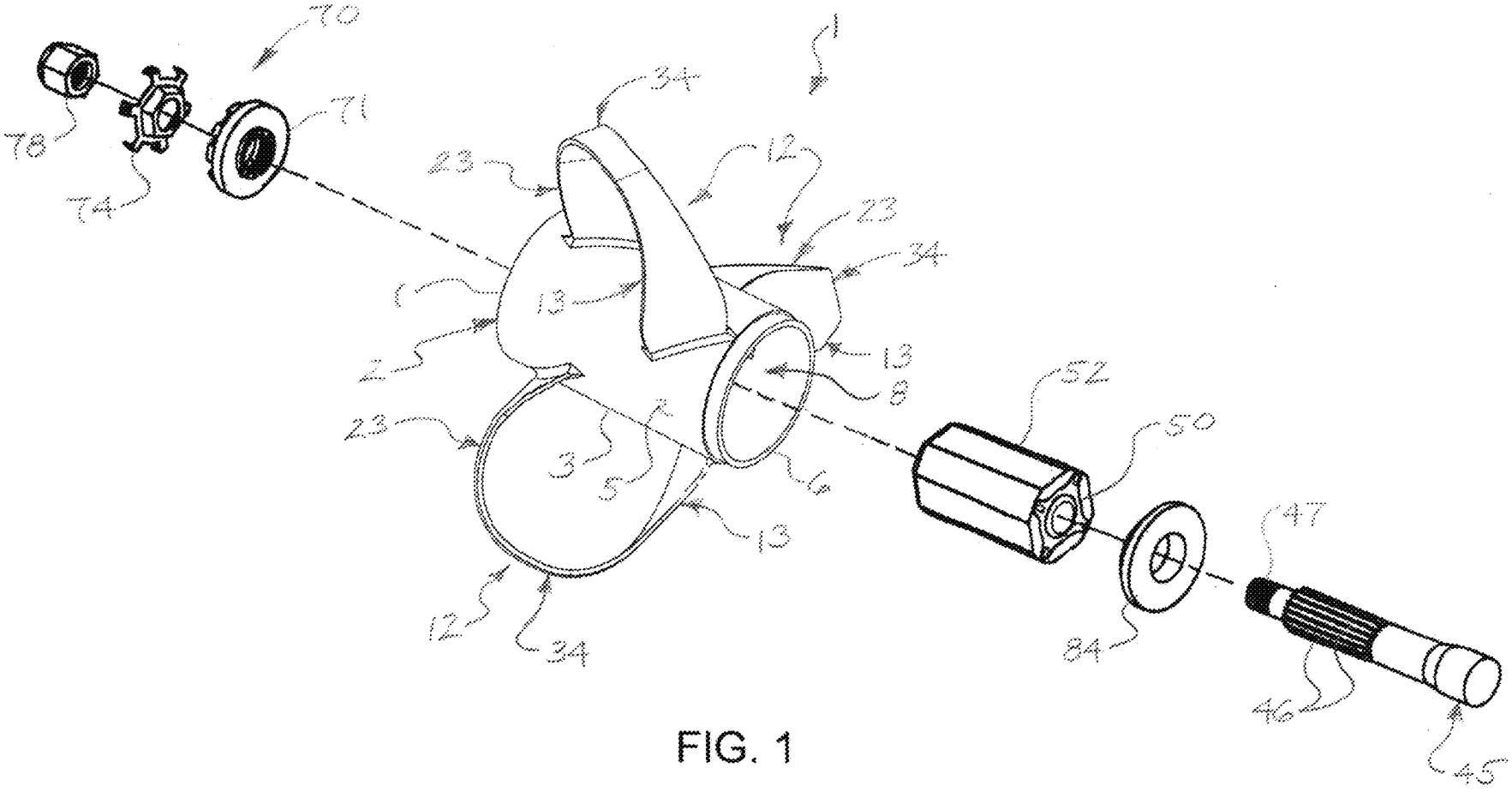
FIG. 1 is an exploded front perspective view of an illustrative embodiment of the enhanced performance parallel loop blade propellers.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the subject matter as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

All methods set forth in the present disclosure may be performed in any suitable order of steps unless otherwise indicated herein or contradicted by the rules of logic. The use of any and all examples or exemplary language provided herein is intended to clearly describe the subject matter of the disclosure and is not intended to be limiting on the scope of the subject matter set forth in the claims. No element, step, ingredient, or limitation mentioned or described in the specification shall not be construed as regarding any unclaimed component, step, or limitation to be essential in practicing the claimed subject matter.

Unless expressly or implicitly indicated otherwise, throughout the description and the appended claims, the terms "comprise", "comprising", "comprised of" and the like are to be construed in an inclusive sense as opposed to an exclusive or exhaustive sense, and are equivalent to the phrase, "including but not limited to". Each embodiment disclosed herein can comprise, consist essentially of, or consist of its particular stated element, step, ingredient, or limitation. As used herein, the transition terms "comprise", "comprises", "comprising", "include", "includes", "including", "is", "has", "having" or the like means "includes, but is not limited to, and allows for the inclusion of unspecified elements, steps, ingredients, or limitations, even in major amounts". The transitional phrase "consisting of" excludes any element, step, ingredient, or limitation not specified. The transition phrase "consisting essentially of" shall limit the scope of the embodiment to the specified elements, steps, ingredients, or limitations and to those that do not materially affect the embodiment. Throughout the written description, drawings and claims appended hereto, unless otherwise noted, it shall be recognized and understood that each embodiment of the described, illustrated and claimed subject matter may comprise, consist essentially of, or consist of any component, element or combination of components or elements set forth herein.

Unless otherwise noted using precise or limiting terminology, all numbers which express quantities of ingredients throughout the specification and claims are to be understood as being approximations of the numerical value cited to express the quantities of those ingredients. As used throughout the specification and claims, the terms "generally" and "about" have the meaning reasonably ascribed to it by a person skilled in the art when used in conjunction with a stated numerical value or range, i.e., denoting from the exact stated value or range to somewhat more or somewhat less than the stated value or range, from a deviation of from 0% with respect to the stated value or range to up to and including 20% of the stated value or range in either direction.

Various illustrative embodiments of the disclosure are described herein. Variations on the described illustrative embodiments may become apparent to those of ordinary skill in the art in reading the specification, drawings and claims of the disclosure. Accordingly, the disclosure encompassed by the specification, claims and drawings includes all modifications and equivalents of the subject matter recited in the claims as permitted by applicable law. Additionally, any combination of the elements in all possible variations thereof is encompassed by the subject matter of the disclosure unless otherwise indicated herein.

Referring initially to FIGS. 1-9 of the drawings, an illustrative embodiment of the enhanced performance parallel loop blade propellers of the disclosure, hereinafter propeller, is generally indicated by reference numeral 1. In some applications, the propeller 1 may be a marine propeller which, in typical application, may be deployed on a marine vehicle (not illustrated) and immersed in a body of water on which the marine vehicle floats to propel the marine vehicle on the water body. In other embodiments, the propeller 1 may be any type of fluid mover which facilitates flow of a fluid.

The propeller 1 may include a propeller hub 2. The propeller hub 2 may have a fore hub end 6 and an aft hub end 7. Multiple looped blade pairs 12 may extend from the propeller hub 2 in spaced-apart relationship to each other between the fore hub end 6 and the aft hub end 7. Each looped blade pair 12 may include a fore blade 13 which may extend from the propeller hub 2 proximate the fore hub end 6. As illustrated in cross-section in FIG. 9, the fore blade 13 of each looped blade pair 12 may be disposed within a blade pitch plane 43. An aft blade 23 may extend from the propeller hub 2 proximate the aft hub end 7. As further illustrated in FIG. 9, the aft blade 23 of each looped blade pair 12 may be disposed generally within the blade pitch plane 43 of the fore blade 13 in the adjacent looped blade pair 12. Accordingly, the fore blade 13 and the aft blade 23 in each looped blade pair 12 may be disposed in generally parallel relationship to each other. A blade bridge 34 may extend from the fore blade 13 to the aft blade 23 of each looped blade pair 12. In some embodiments, the blade bridge 34 may have a curved or arced trajectory from the fore blade 13 to the aft blade 23.

Figure 7:
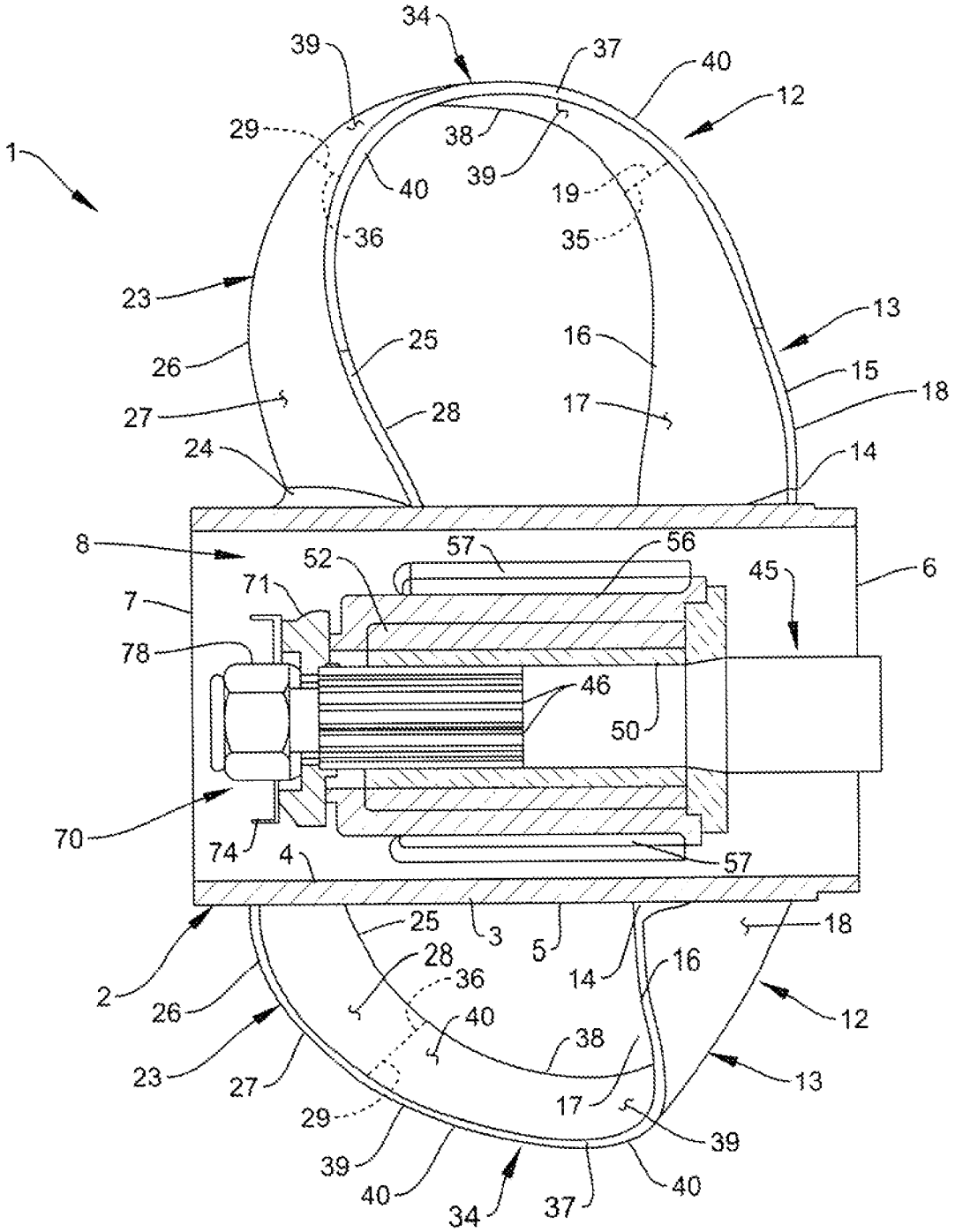
FIG. 7 is a longitudinal sectional view of the propeller hub of the illustrative propeller illustrated in FIG. 6.

As illustrated in FIG. 7, the propeller hub 2 of the propeller 1 may include a propeller hub wall 3. The propeller hub wall 3 may be elongated and cylindrical with the fore hub end 6 and the aft hub end 7 at opposite ends of the propeller hub wall 3. In some embodiments, a hub interior 8 may traverse the propeller hub wall 3 from the fore hub end 6 to the aft hub end 7. The propeller hub wall 3 may have an interior hub wall surface 4 which faces the hub interior 8 and an exterior hub wall surface 5 which is opposite the interior hub wall surface 4.

As further illustrated in FIG. 7, in some embodiments, a central propeller hub drive sleeve 56 may be disposed in the hub interior 8 of the propeller 1. Multiple hub vanes 57 may extend between the propeller hub drive sleeve 56 and the interior hub wall surface 4 of the propeller hub wall 43. In some embodiments, the propeller hub drive sleeve 56 of the propeller hub 2 may be wedge-shaped and may gradually narrow or taper from the aft hub end 7 to the fore hub end 6 of the propeller hub 2. In other embodiments, the propeller hub drive sleeve 56 may be non-tapered and uniform in width from the aft hub end 7 to the fore hub end 6 of the propeller hub 2. The interior surface of the propeller hub drive sleeve 56 may include alternating interior lug slots and hug drive sleeve flats (not illustrated) which may extend along at least a portion of the length of the propeller hub drive sleeve 56 for purposes which will be hereinafter described.

As illustrated in FIGS. 1 and 7, an adapter sleeve 52 may be disposed within the propeller hub drive sleeve 56. The adaptor sleeve 52 may drivingly engage the propeller hub drive sleeve 56 for rotation via any suitable drive interface, such as via interfacing splines and grooves (not illustrated) in the interior surfaces of the adaptor sleeve 52 and the propeller hub drive sleeve 56, for example and without limitation. In some embodiments, the adaptor sleeve 52 may additionally or alternatively drivingly engage the propeller hub drive sleeve 56 via alternating interfacing lug slots and flats (not illustrated) in the exterior surface of the adaptor sleeve 52 and the interior surface of the propeller hub drive sleeve 56. In some embodiments, the adaptor sleeve 52 may include at least one elastomeric material such as rubber, for example and without limitation.

A drive adaptor 50 may be disposed within the adaptor sleeve 52. The drive adaptor 50 may drivingly engage the adaptor sleeve 52 for rotation via interfacing splines and grooves, lug slots and flats and/or other suitable drive interface (not illustrated). The interior surface of the drive adaptor 50 may be sized and splined to drivingly interface with a propeller drive shaft 45 having exterior drive shaft splines 46. In some applications of the propeller 1, the propeller drive shaft 45 may be drivingly engaged by an outboard boat motor on a marine vehicle (not illustrated), typically in the conventional manner. As illustrated in FIG. 1, drive shaft threads 47 may terminate the aft end of the propeller drive shaft 45 typically for purposes which will be hereinafter described. The drive adaptor 50 may include at least one hard and/or rigid material such as metal and/or composite. For example and without limitation, in some embodiments, the drive adaptor 50 may include at least one metal such as stainless steel, aluminum alloy, bronze or combinations thereof.

As illustrated in FIG. 1, in some embodiments, a lock assembly 70 may be deployed to secure the propeller 1 on the propeller drive shaft 45. In some embodiments, the lock assembly 70 may include a lock adaptor 71 which may be placed over the aft end of the propeller drive shaft 45. A tab washer 74 may engage the lock adaptor 71. A lock nut 78 may threadably engage the drive shaft threads 47 on the aft end of the propeller drive shaft 45 and tightened against the tab washer 74. It will be recognized and understood by those skilled in the art that the propeller 1 may be mounted on the propeller drive shaft 45 for rotation thereby using any of a variety of techniques which may be suitable for the purpose.

Figure 6:
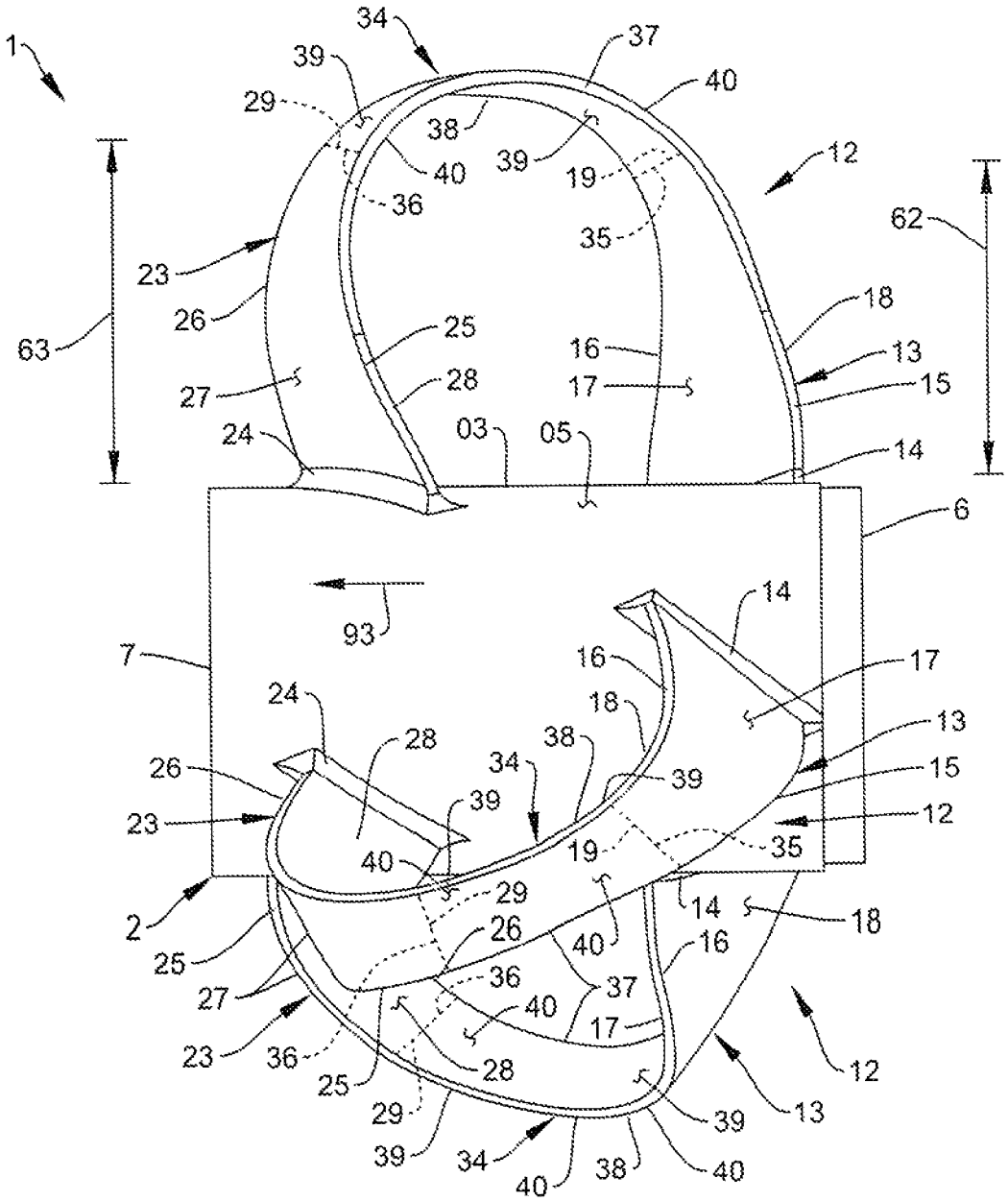
FIG. 6 is a right side view of the illustrative propeller.
Figure 9:
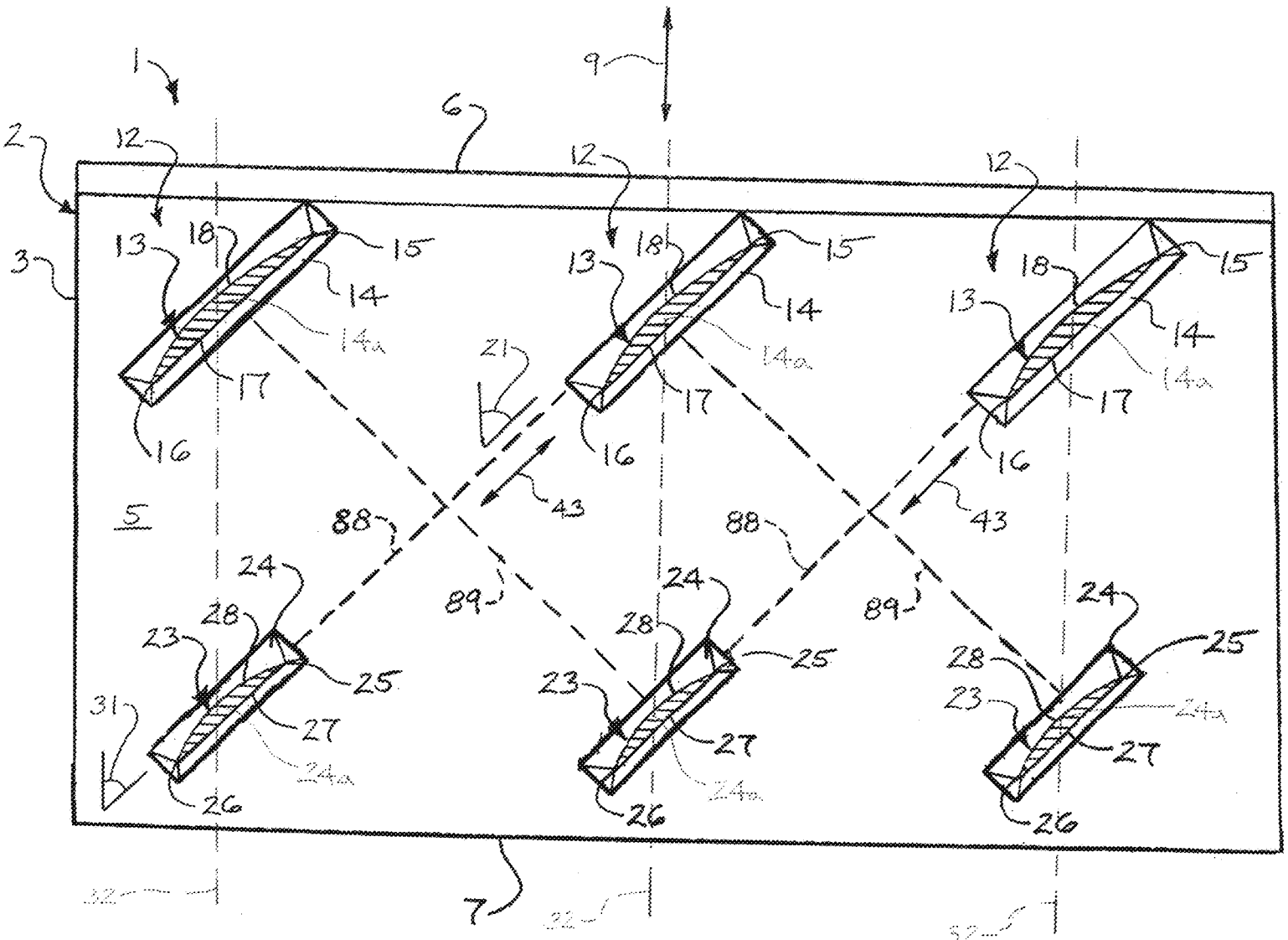
FIG. 9 is a cross-sectioned two-dimensional planar side view of the illustrative propeller illustrated in FIG. 8, with the fore blade and the aft blade of each looped blade pair illustrated in cross-section and more particularly illustrating a longitudinal blade root centerline of the aft blade of each looped blade pair intersecting the transverse blade root centerline of the fore blade of the adjacent looped blade pair.
Figure 10:
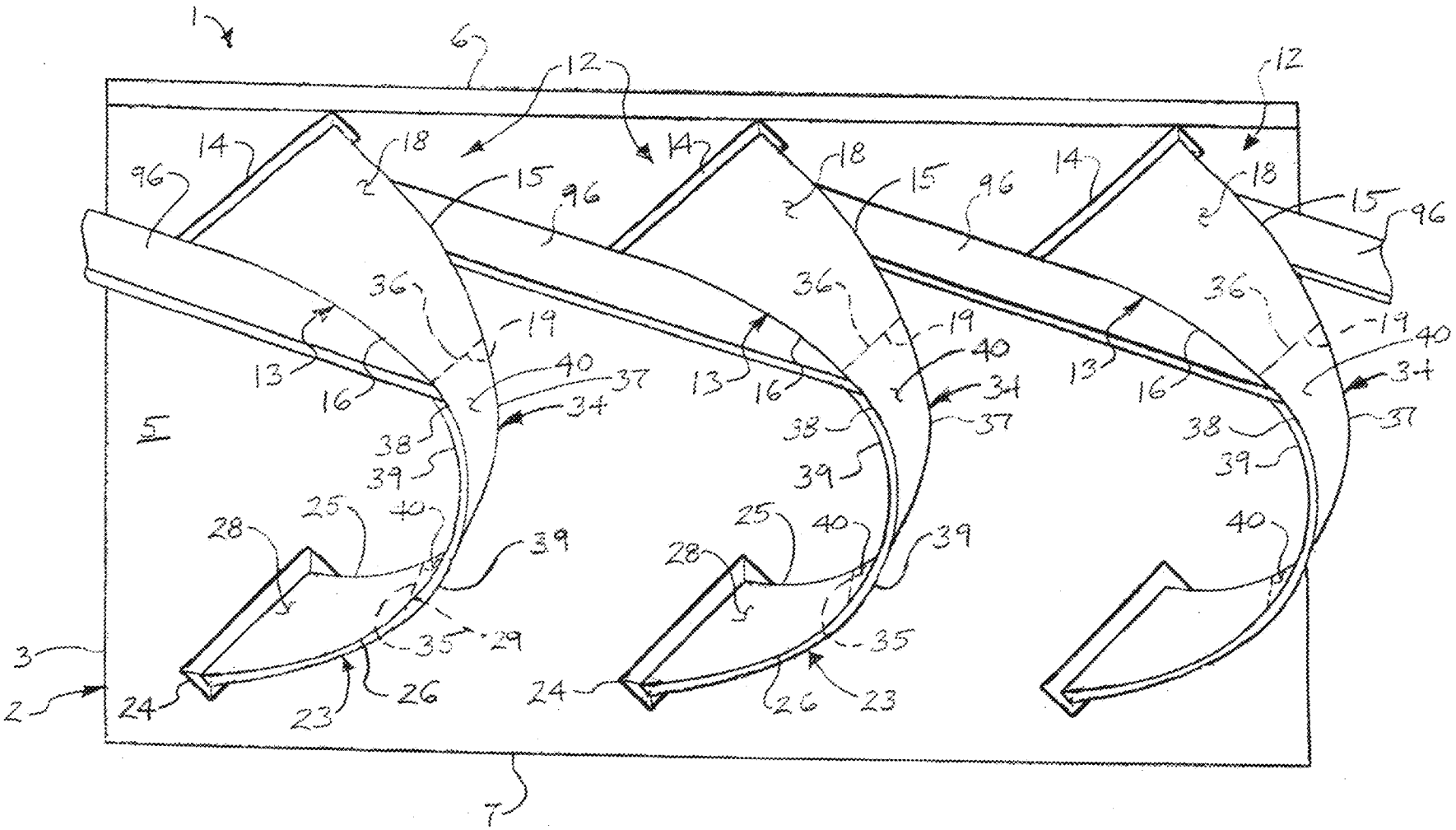
FIG. 10 is a two-dimensional planar side view of an illustrative embodiment of the enhanced performance parallel loop blade propellers with three looped blade pairs extending from the exterior hub wall surface of the propeller hub and a pair of blade connecting members connecting the adjacent looped blade pairs in a biplane blade arrangement.
Figure 11A:
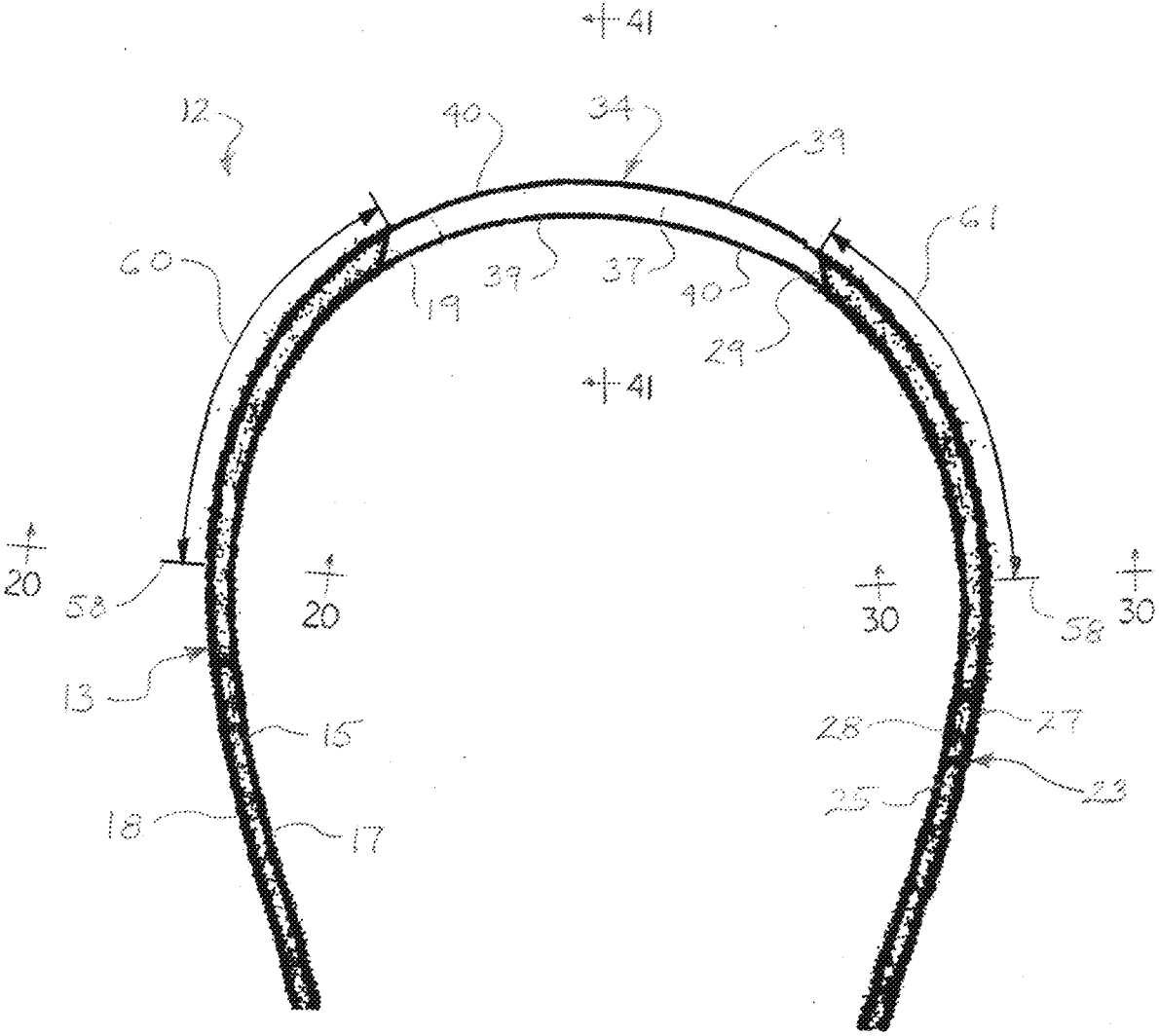
FIG. 11A is a two-dimensional planar leading-edge view of a typical looped blade pair of an illustrative embodiment of the enhanced performance parallel loop blade propellers with the blade bridge having a blade bridge chord width which is substantially the same as the fore blade chord width and the aft blade chord width at the beginning of blade curvature of the fore blade and the aft blade, respectively
Figure 12:
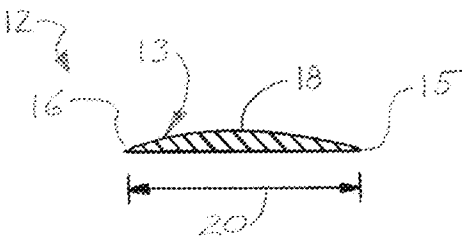
FIG. 12 is a cross-sectional view, taken along section lines 12-12 in FIGS. 11A and 11B, of the fore blade of the looped blade pair.
Figure 13:
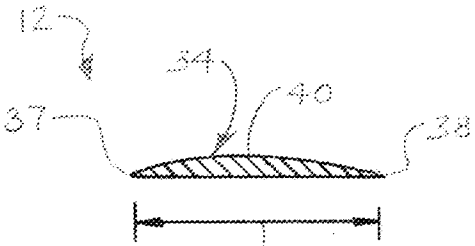
FIG. 13 is a cross-sectional view, taken along section lines 13-13 in FIGS. 11A and 11B, of the blade bridge of the looped blade pair.
Figure 14:
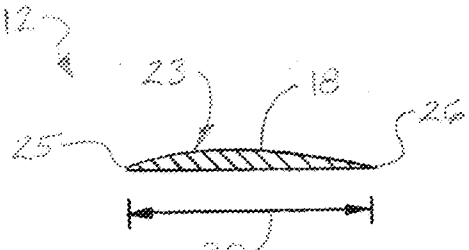
FIG. 14 is a cross-sectional view, taken along section lines 14-14 in FIGS. 11A and 11B, of the aft blade of the looped blade pair.
Figure 11B:
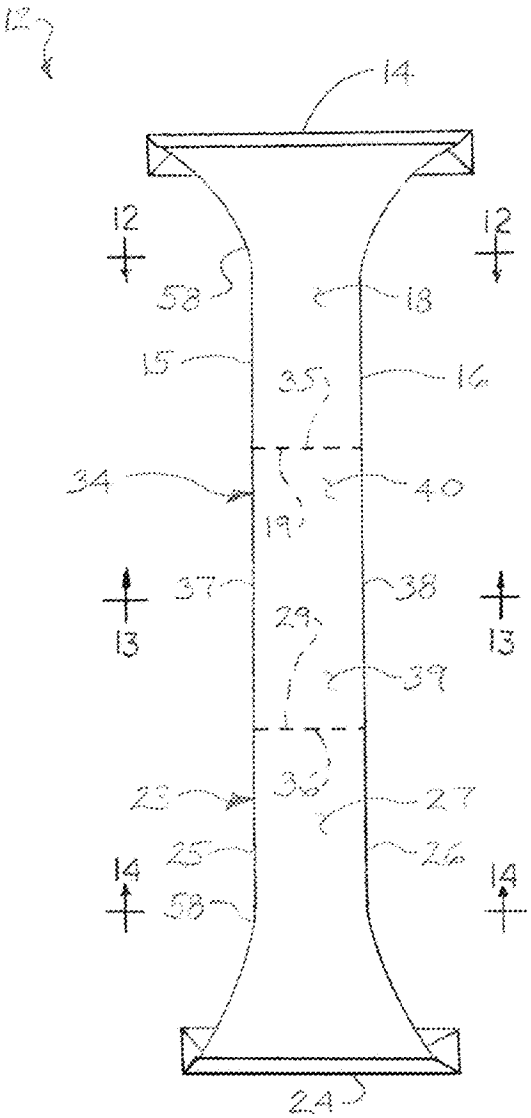
FIG. 11B is a two-dimensional planar exterior view of the looped blade pair of the illustrative enhanced performance parallel loop blade propeller illustrated in FIG. 11A.

As illustrated in FIGS. 2-6, the fore blade 13 of each looped blade pair 12 may include a fore blade root 14 on the exterior wall surface 5 of the propeller hub wall 3. As illustrated in FIGS. 9 and 10, the fore blade root 14 may have a fore blade root midpoint **14*a* which is halfway or midway between the opposite sides or ends of the fore blade root 14. As illustrated in FIG. 9, the fore blade root 14 may be oriented at a selected fore blade pitch angle 21 with respect to a longitudinal hub axis 9, or travel axis, of the propeller hub 2. The fore blade 13 may have a leading fore blade edge 15 and a trailing fore blade edge 16 which extend from the fore blade root 14 and terminate at a fore blade tip 19. In some embodiments, the leading fore blade edge 15 and the trailing fore blade edge 16 may curve or taper inwardly toward each other from the relatively wider fore blade root 14 to the relatively narrower fore blade tip 19. A fore blade pressure face 17 and a fore blade suction face 18 may extend between the leading fore blade edge 15 and the trailing fore blade edge 16 from the fore blade root 14 to the fore blade tip 19. The fore blade pressure face 17 may be disposed toward or proximate the aft hub end 7 whereas the fore blade suction face 18 may be disposed away from the aft hub end 7 and toward the fore hub end 6. As particularly illustrated in FIGS. 2-6, from the fore blade root 14 to the fore blade tip 19, the fore blade 13 of each looped blade pair 12 may gradually arc or curve away from the fore hub end 6 toward the aft hub end 7 of the propeller hub 2. The fore blade pressure face 17 may face the aft hub end 7, whereas the fore blade suction face 18 may face the fore hub end 6. As illustrated in FIG. 6, the fore blade 13 may have a fore blade diameter 62 as measured in a straight line from the fore blade root 14 to the fore blade tip 19**.

Figure 8:
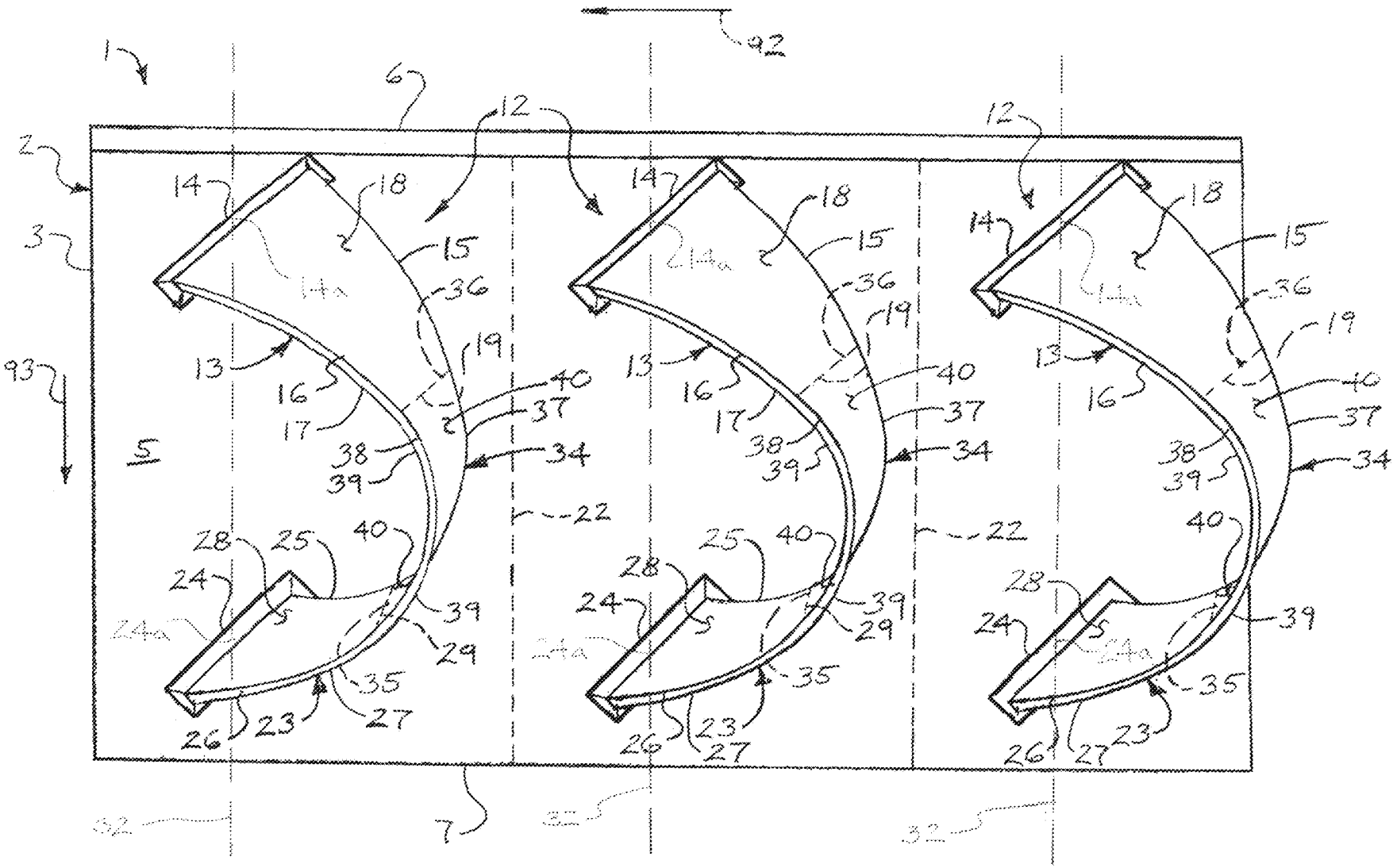
FIG. 8 is a two-dimensional planar side view of the illustrative propeller with three looped blade pairs extending from the exterior hub wall surface of the propeller hub.

As further illustrated in FIGS. 2-6, the aft blade 23 of each looped blade pair 12 may include an aft blade root 24 on the exterior wall surface 5 of the propeller hub wall 3. As illustrated in FIGS. 9 and 10, the aft blade root 24 may have an aft blade root midpoint **24*a* which is halfway or midway between the opposite sides or ends of the aft blade root 24. As illustrated in FIG. 9, the aft blade root 24 may be disposed at a selected aft blade pitch angle 31 with respect to the longitudinal hub axis 9 of the propeller hub 2. In some embodiments of the propeller 1, each fore blade 13 and each aft blade 23 of each looped blade pair 12 may have a longitudinal blade root centerline 88 which may be oriented along or parallel to the longitudinal axis of each blade root. Each fore blade 13 and each aft blade 23 of each looped blade pair 12 may have a transverse blade root centerline 89 which is oriented perpendicular to the longitudinal axis of each blade root. Accordingly, the fore blade root 14 on the fore blade 13 of each looped blade pair 12 may be disposed in in-line relationship with respect to the aft blade root 24 on the aft blade 23 of each adjacent looped blade pair 12 along the transverse blade root centerline 89. The longitudinal blade root centerline 88 of each aft blade 23 in each looped blade pair 12 may intersect the transverse blade root centerline 89 of the fore blade 13 in the adjacent looped blade pair 12. As illustrated in FIGS. 8 and 9, the fore blade root midpoint 14*a* of the fore blade root 14 on the fore blade 13 and the aft blade root midpoint 24*a* of the aft blade root 24 on the aft blade 23 in each looped blade pair 12 may be disposed in in-line relationship with respect to each other along a blade root inline axis 32 which passes through the fore blade root midpoint 14*a* and the aft blade root midpoint 24*a*. As illustrated in FIG. 9, the blade root in-line axis 32 may be generally parallel to the longitudinal hub axis 9 of the propeller hub 2**.

The aft blade 23 may have a leading aft blade edge 25 and a trailing aft blade edge 26 which extend from the aft blade root 24 and terminate at an aft blade tip 29. In some embodiments, the leading aft blade edge 25 and the trailing aft blade edge 26 may curve or taper inwardly toward each other from the aft blade root 24 to the aft blade tip 29. An aft blade pressure face 27 and an aft blade suction face 28 may extend between the leading aft blade edge 25 and the trailing aft blade edge 26 from the aft blade root 24 to the aft blade tip 29. The aft blade pressure face 27 may be disposed toward or proximate the aft hub end 7 whereas the aft blade suction face 28 may be disposed away from the aft hub end 7 and toward the fore hub end 6. As particularly illustrated in FIGS. 2-6, from the aft blade root 24 to the aft blade tip 29, the aft blade 23 of each looped blade pair 12 may gradually arc or curve away from the aft hub end 7 toward the fore hub end 6. The aft blade tip 29 may terminate in registration or alignment and in spaced-apart relationship with respect to the fore blade tip 19 of the fore blade 13. The aft blade pressure face 27 may face the aft hub end 7, whereas the aft blade suction face 28 may face the fore hub end 6. As illustrated in FIG. 6, the aft blade 23 may have an aft blade diameter 63 as measured in a straight line from the aft blade root 24 to the aft blade tip 29.

As further illustrated in FIGS. 2-6, the blade bridge 34 may extend from the fore blade tip 19 of the fore blade 13 to the aft blade tip 29 of the aft blade 23. Accordingly, the blade bridge 34 may have a fore blade bridge end 35 at the fore blade tip 19 and an aft blade bridge end 36 at the aft blade tip 29. A leading blade bridge edge 37 and a trailing blade bridge edge 38 may extend from the fore blade bridge end 35 to the aft blade bridge end 36. A blade bridge pressure face 39 and a blade bridge suction face 40 may extend between the leading blade bridge edge 37 and the trailing blade bridge edge 38 from the fore blade bridge end 35 to the aft blade bridge end 36. In some embodiments, the blade bridge 34 may be continuous and contiguous with and may have the same material composition as the fore blade 13 and the aft blade 23. The leading blade bridge edge 37, the trailing blade bridge edge 38, the blade bridge pressure face 39 and the blade bridge suction face 40 may thus be continuous and contiguous with the respective leading fore blade edge 15, trailing fore blade edge 16, fore blade pressure face 17 and fore blade suction face 18 of the fore blade 13 and with the respective leading aft blade edge 25, trailing aft blade edge 26, aft blade pressure face 27 and aft blade suction face 18 of the aft blade 23.

The fore blade pressure face 17 of the fore blade 13 may be disposed on the inside and the fore blade suction face 18 on the outside of the arc which is formed by the fore blade 13, the aft blade 23 and the blade bridge 34. Conversely, the aft blade pressure face 27 of the aft blade 23 may be disposed on the outside and the aft blade suction face 28 on the inside of the arc. Accordingly, as the blade bridge 34 transitions from the fore blade 13 to the aft blade 23, the blade bridge pressure face 39 and the blade bridge suction face 40 may in like manner transition from the interior to the exterior of the arc.

As illustrated in FIG. 8, in some embodiments, the average chord width of each looped blade pair 12, which may include the average chord width of the fore blade 13, the aft blade 23 and the blade bridge 34, including the midpoint distance 22 between adjacent looped blade pairs 12, may be equal to 360 degrees divided by the number of looped blade pairs 12.

As illustrated in FIG. 1, in typical application, the propeller 1 may be assembled on the marine vehicle (not illustrated) to propel the marine vehicle on a water body. Accordingly, the propeller hub 2 of the propeller 1 may be disposed in driving engagement with the propeller drive shaft 45. The drive adaptor 50 may be inserted in the adaptor sleeve 52, and the adaptor sleeve 52 may be inserted in the propeller hub drive sleeve 56 (FIG. 7). The propeller drive shaft 45 may be inserted typically initially through a thrust washer 84 and then through the drive adaptor 50 in the adaptor sleeve 52 as the drive shaft splines 46 on the propeller drive shaft 45 mesh with the companion shaft bore splines (not illustrated) in the drive adaptor 50. The lock assembly 70 may be deployed to secure the propeller 1 on the propeller drive shaft 45.

Figure 2:
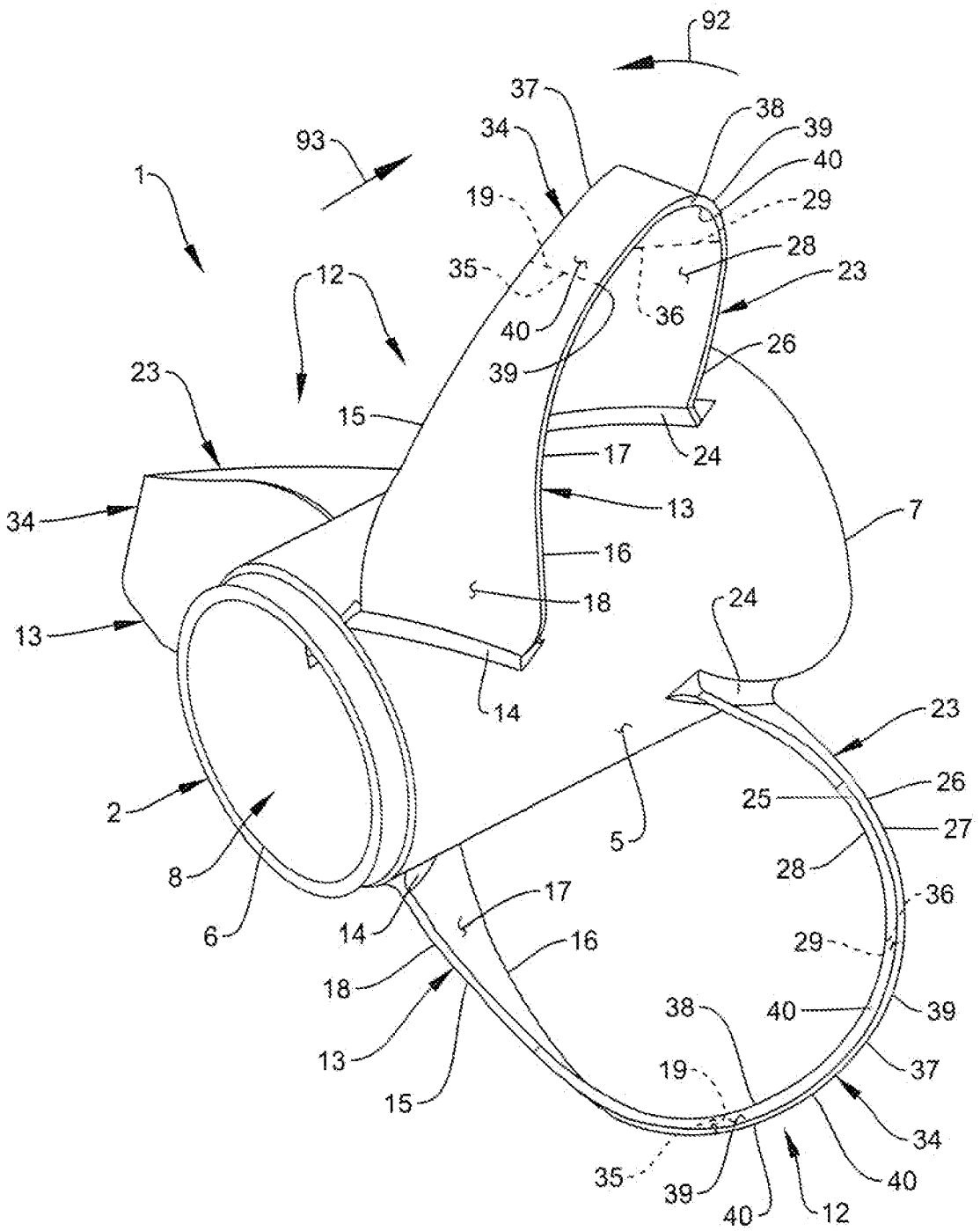
FIG. 2 is a front perspective view of the illustrative propeller shown in FIG. 1.
Figure 3:
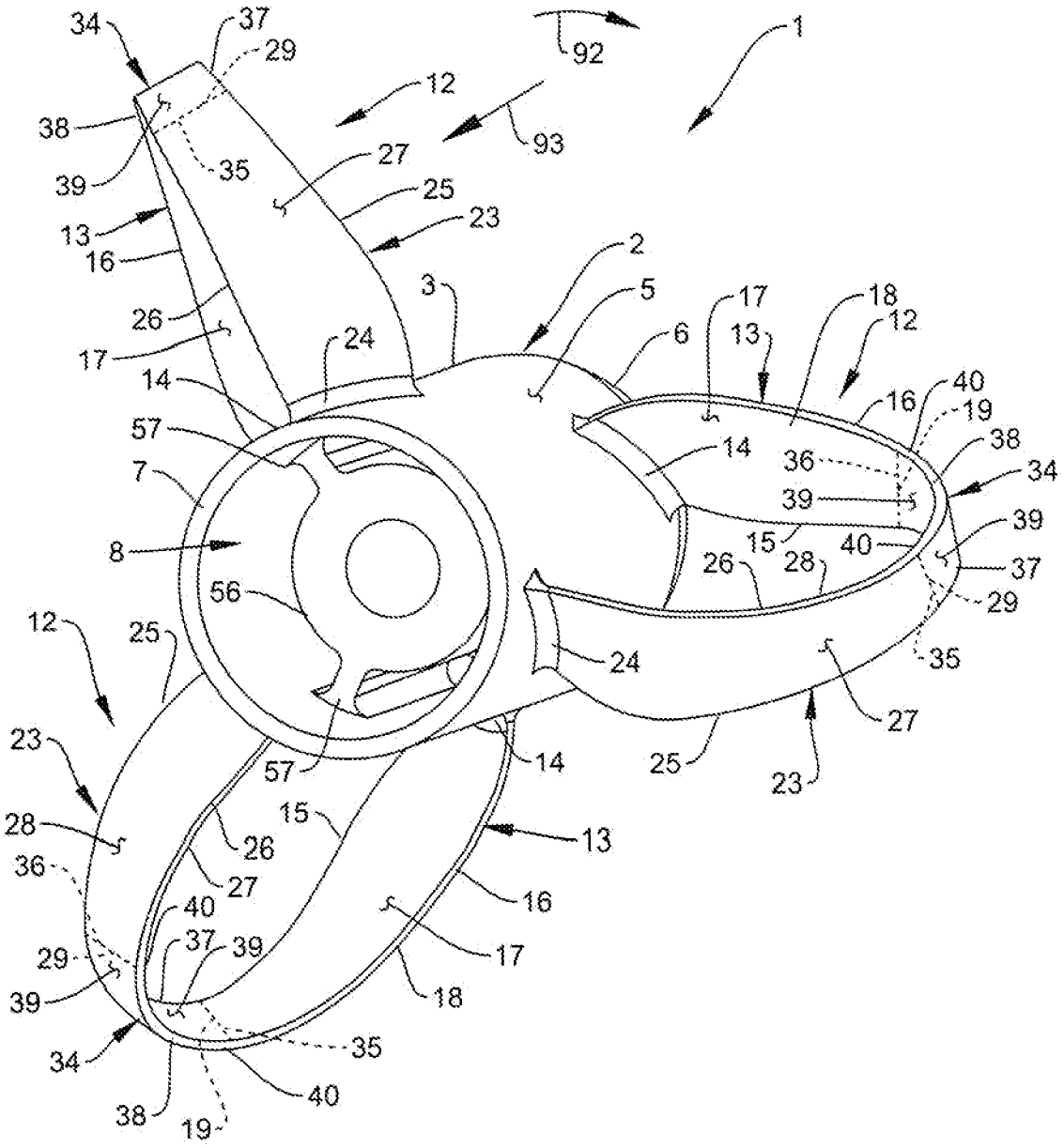
FIG. 3 is a rear perspective view of the illustrative propeller.
Figure 4:
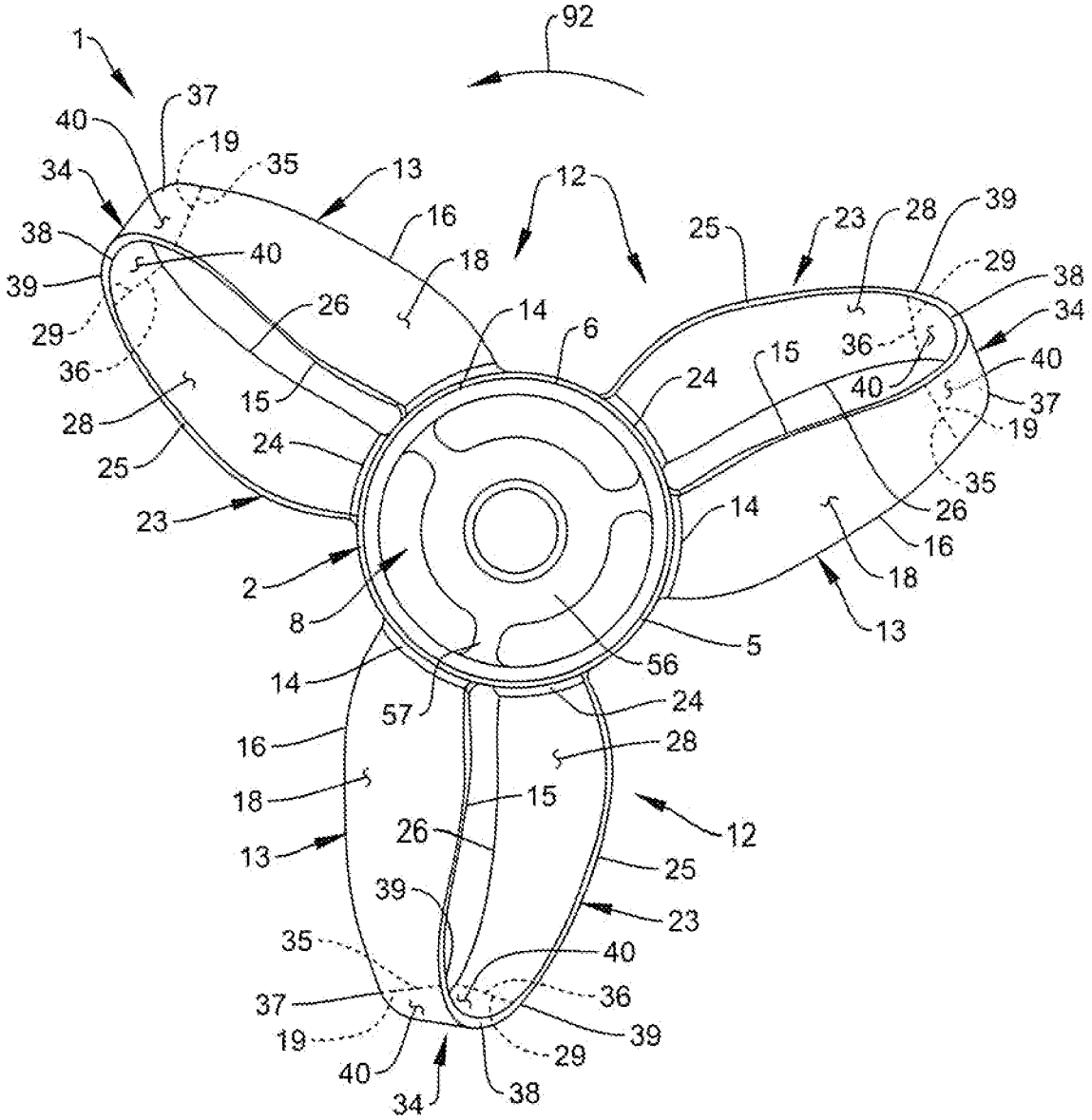
FIG. 4 is a front view of the illustrative propeller.
Figure 5:
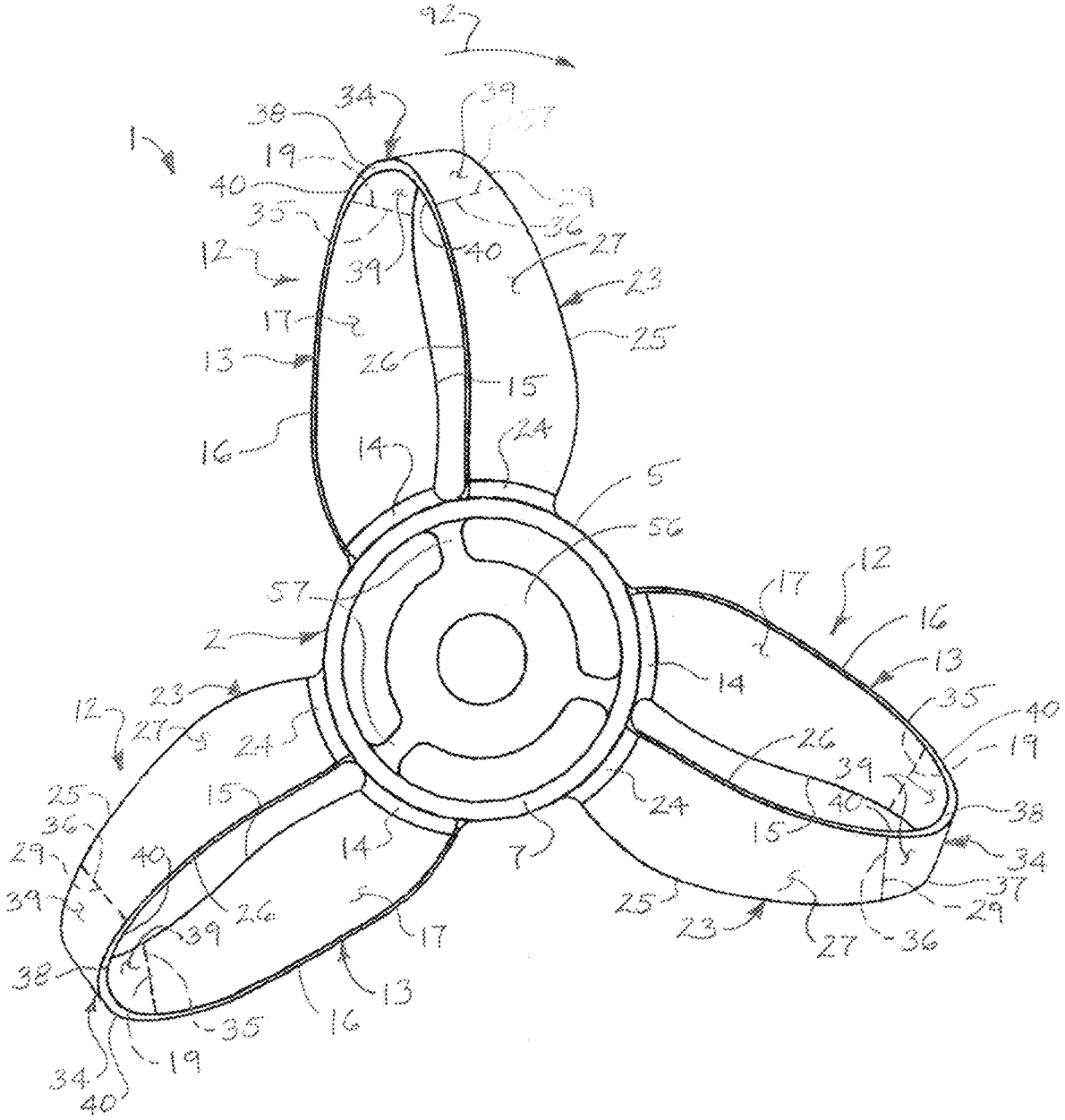
FIG. 5 is a rear view of the illustrative propeller.

The propeller 1 may be immersed in the water body as the marine vehicle is placed thereon. Responsive to operation of the motor (not illustrated) of the marine vehicle, the propeller drive shaft 45 may simultaneously rotate the propeller 1, typically via the drive adaptor 50, the adaptor sleeve 52, the propeller hub drive sleeve 56 and the hub vanes 57, respectively, in the forward rotational direction 92 (FIGS. 2-5) as the looped blade pairs 12 propel the propeller 1 and the marine vehicle on the water. As illustrated in FIGS. 2 and 3, the looped blade pairs 12 may thus pull water in the water body rearwardly through the propeller 1 as the water flows in a fluid flow direction 93 from the fore hub end 6 to the aft hub end 7 of the propeller hub 2. The parallel orientation of the fore blade 13 with respect to the aft blade 23 in each looped blade pair 12 may enhance and/or attenuate performance of the propeller 1 for various applications as the propeller 1 propels the marine vehicle on the water body. Various other performance enhancing and/or attenuating features of the fore blade 13, the aft blade 23 and/or the blade bridge 34 in each looped blade pair 12 of the propeller 1 will be hereinafter described.

Referring next to FIG. 10 of the drawings, in some embodiments of the propeller 1, at least one blade connecting member 96 may connect the adjacent looped blade pairs 12 to each other on the propeller hub 2 in a biplane blade arrangement. For example and without limitation, in some embodiments, at least one blade connecting member 96 may connect the leading fore blade edge 15 on the fore blade 13 of each looped blade pair 12 to the trailing fore blade edge 16 on the fore blade 13 of the adjacent looped blade pair 12. Additionally or alternatively, at least one blade connecting member 96 may connect the aft blades 23 and/or the blade bridges 34 of the adjacent looped blade pairs 12 to each other.

Referring next to FIGS. 11A-14 of the drawings, in some embodiments of the propeller 1, the blade bridge chord 34 of each looped blade pair 12 may have a blade bridge chord width 41 which is substantially the same as the fore blade chord width 20 of the fore blade 13 at the beginning of blade curvature 58 of the fore blade 13 toward the blade bridge 34. Additionally or alternatively, the blade bridge chord width 41 of the blade bridge chord 34 may be substantially the same as the aft blade chord width 30 of the aft blade 23 at the beginning of blade curvature 58 of the aft blade 23 toward the blade bridge 34. In some embodiments of the propeller 1, the fore blade 13, the aft blade 23 and the blade bridge 34 of each looped blade pair 12 may have a substantially equal fore blade chord width 20, aft blade chord width 30 and blade bridge chord width 41, respectively, at the point of connection of the fore blade 13 and the aft blade 23 with the blade bridge 34.

Figure 16:
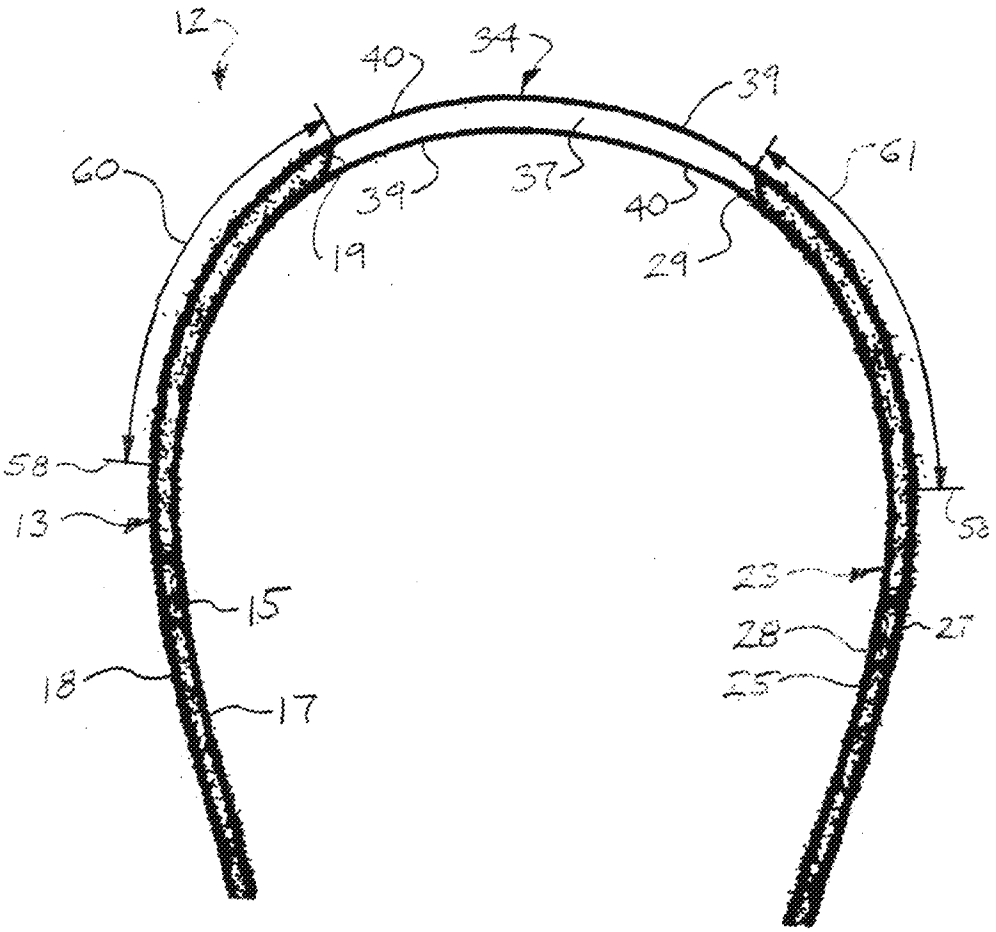
FIG. 16 is a two-dimensional planar leading blade edge view of the looped blade pair illustrated in FIG. 15.
Figure 15:
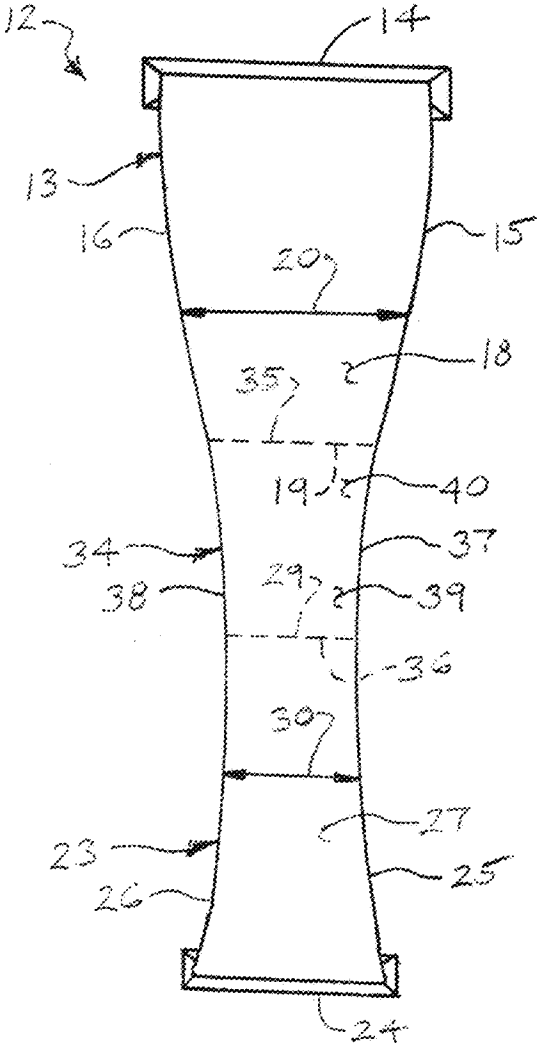
FIG. 15 is a two-dimensional planar exterior view of a looped blade pair of an illustrative embodiment of the enhanced performance parallel loop blade propellers in which the fore blade has a blade tip that extends towards the aft blade in a curved radius for a distance which is at least equal to the chord width of the fore blade at the last radii before the beginning of blade curvature.

Referring next to FIGS. 15 and 16 of the drawings, in some embodiments of the propeller 1, the fore blade 13 of each looped blade pair 12 may have a fore blade tip 19 that extends towards the aft blade 23 in a curved radius distance 60 which is at least equal to the fore blade chord width 20 of the fore blade 13 at the last radius of the fore blade 13 before the beginning of the blade curvature 58. Additionally or alternatively, the aft blade 23 of each looped blade pair 12 may have an aft blade tip 29 that extends towards the fore blade 13 in a curved radius distance 61 which is at least equal to the aft blade chord width 30 of the aft blade 23 at the last radius of the aft blade 23 before the beginning of the blade curvature 58.

As further illustrated in FIG. 15, in some embodiments, the blade bridge 34 may be generally wider at its connection to the fore blade 13 than at its connection to the aft blade 23. Accordingly, the blade bridge 34 may gradually narrow in width as it extends from the fore blade tip 19 of the fore blade 13 towards the aft blade tip 29 of the aft blade 23. Conversely, in some embodiments, the blade bridge 34 may be generally wider at its connection to the aft blade 23 than at its connection to the fore blade 13 and may gradually narrow in width as it extends from the aft blade 23 towards the fore blade 13.

Figure 17:
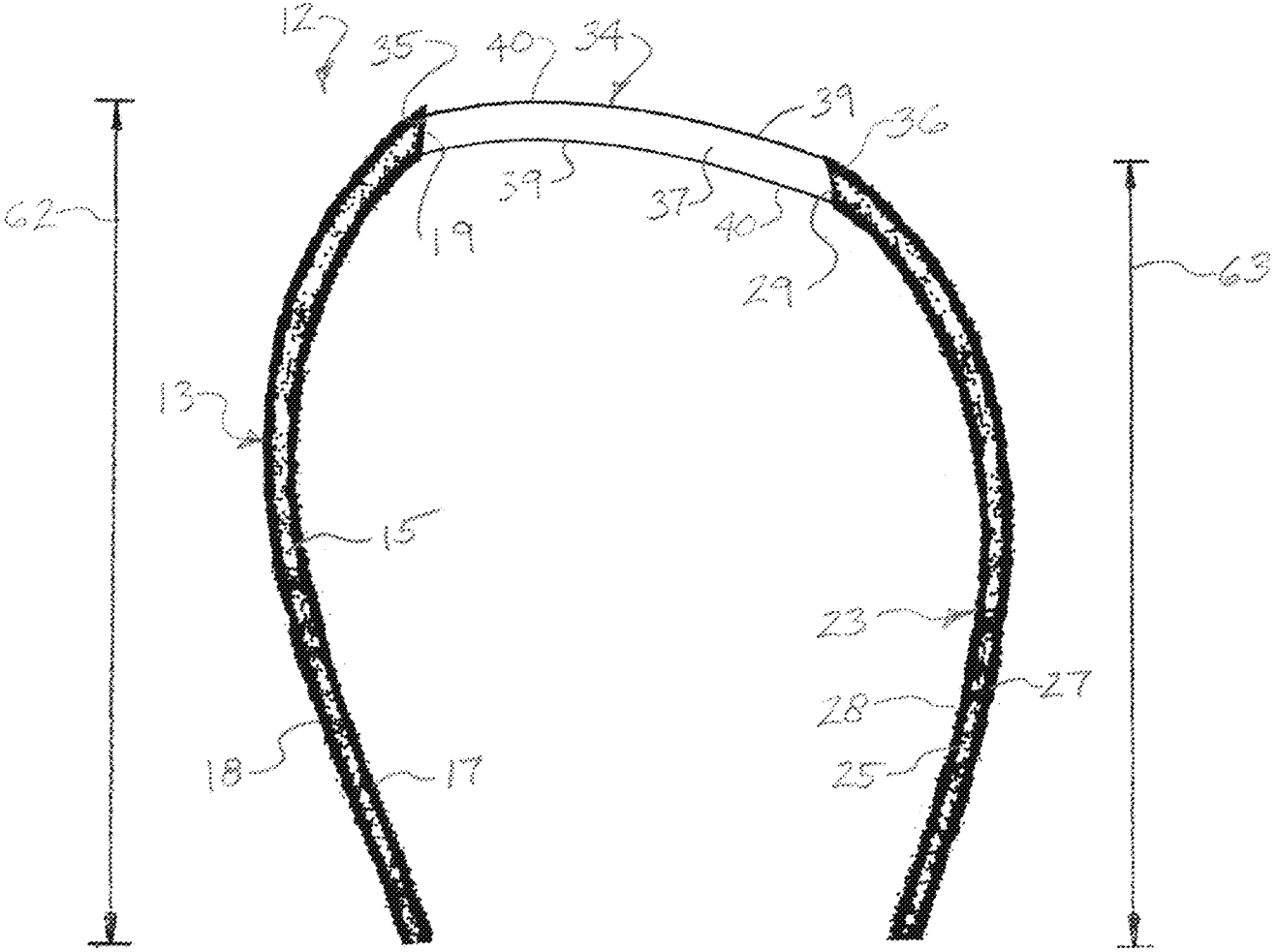
FIG. 17 is a two-dimensional planar leading blade edge view of a looped blade pair of an illustrative embodiment of the enhanced performance parallel loop blade propellers in which the fore blade has a larger blade diameter than the aft blade of the looped blade pair.
Figure 19:
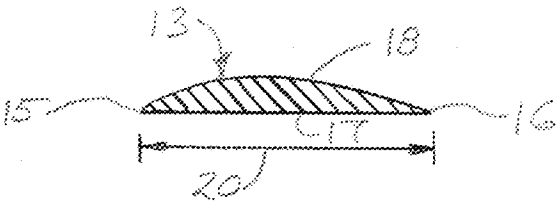
FIG. 19 is a cross-sectional view, taken along section lines 19-19 in FIG. 18, of the fore blade of the looped blade pair.
Figure 20:
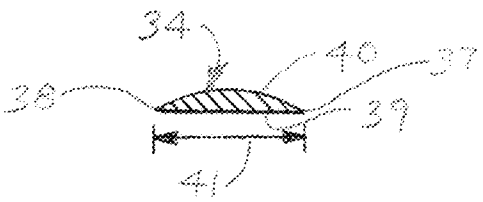
FIG. 20 is a cross-sectional view, taken along section lines 20-20 in FIG. 18, of the blade bridge of the looped blade pair.
Figure 21:
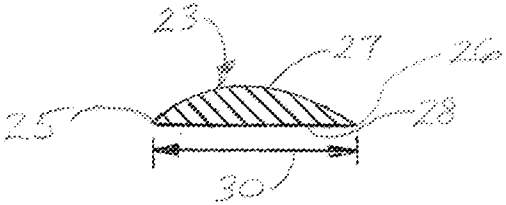
FIG. 21 is a cross-sectional view, taken along section lines 21-21 in FIG. 18, of the aft blade of the looped blade pair.
Figure 18:
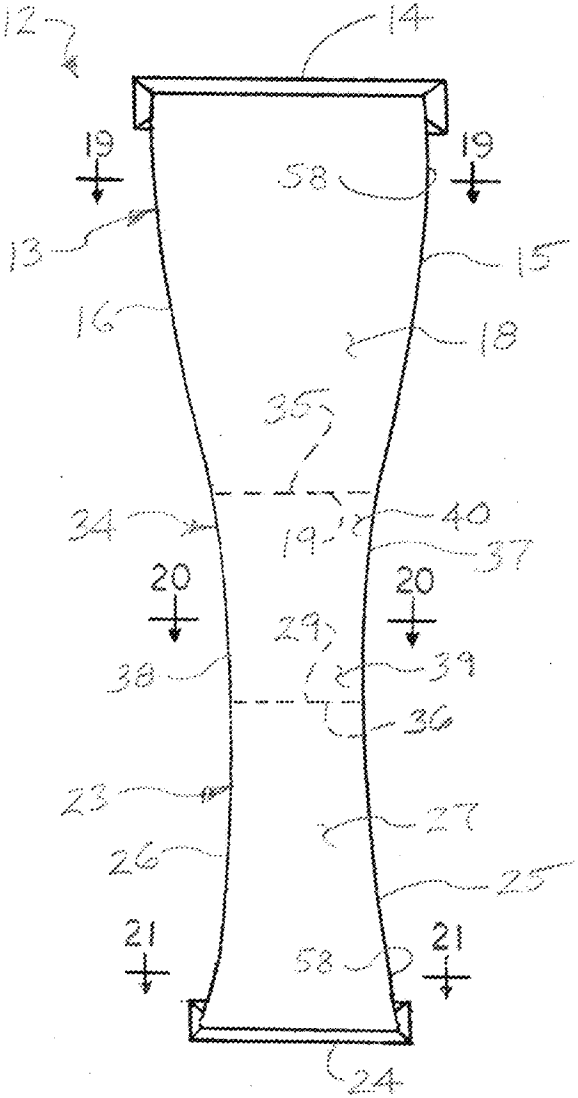
FIG. 18 is a two-dimensional planar exterior view of a looped blade pair of an illustrative embodiment of the enhanced performance parallel loop blade propellers in which the fore blade and the aft blade have different chord widths at the same radii and the blade bridge has a chord width narrower than those of the fore blade and the aft blade.

Referring next to FIG. 17 of the drawings, in some embodiments of the propeller 1, the fore blade 13 may have a fore blade diameter 62 which is larger than the aft blade diameter 63 of the aft blade 23 in each looped blade pair 12. In some embodiments, the aft blade diameter 63 of the aft blade 23 may be larger than the fore blade diameter 62 of the fore blade 13 in each looped blade pair 12. In some embodiments, the aft blade diameter 63 of the aft blade 23 may be generally equal to the fore blade diameter 62 of the fore blade 13 in each looped blade pair 12.

Referring next to FIGS. 18-21 of the drawings, in some embodiments of the propeller 1, the fore blade 13 may have a fore blade chord width 20 which is different than the aft blade chord width 30 of the aft blade chord 23 at each corresponding radius of blade curvature. For example and without limitation, in some embodiments, the fore blade chord width 20 may be greater than the aft blade chord width 30 at the respective radii of blade curvature. In some embodiments, the aft blade chord width 30 may be greater than the fore blade chord width 20 at the respective radii of blade curvature. In some embodiments, the fore blade chord width 20 may be generally the same as the aft blade chord width 30 at the respective radii of blade curvature.

As further r illustrated in FIGS. 18-21, in some embodiments, the blade bridge chord width 41 of the blade bridge 34 of each looped blade pair 12 may be smaller in cross-section than the fore blade chord width 20 of the fore blade 13 and/or the aft blade chord width 30 of the aft blade 23 at the beginning of blade curvature 58 of each corresponding fore blade 13 and/or aft blade 23.

Figure 22:
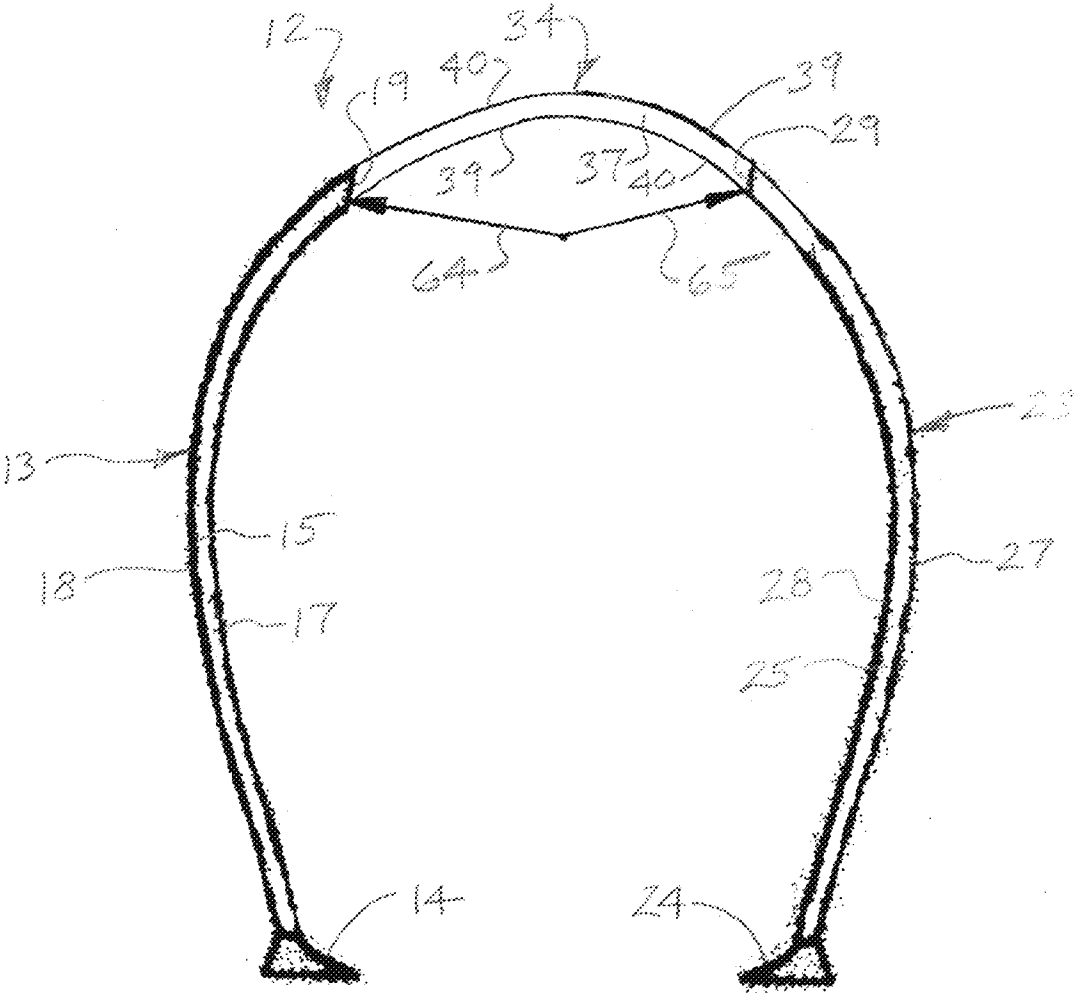
FIG. 22 is a two-dimensional planar leading blade edge view of a looped blade pair of an illustrative embodiment of the enhanced performance parallel loop blade propellers in which the blade bridge has dissimilar curvature radii at its connections to the fore blade and the aft blade.

Referring next to FIG. 22 of the drawings, the blade bridge 34 in each looped blade pair 12 of the propeller 1 may have a fore curvature radius 64 which is the radius of the curved trajectory of the blade bridge 34 from substantially the midpoint of the blade bridge 34 to its connection to the fore blade tip 19 of the fore blade 13. The blade bridge 34 of each looped blade pair 12 may have an aft curvature radius 65 which is the radius of the curved trajectory of the blade bridge 34 from substantially the midpoint of the blade bridge 34 to its connection to the aft blade tip 29 of the aft blade 23. In some embodiments, the fore curvature radius 64 may differ from the aft curvature radius 65. For example and without limitation, in some embodiments, the fore curvature radius 64 may be greater than the aft curvature radius 65, as shown. In some embodiments, the aft curvature radius 65 may be greater than the fore curvature radius 64. In some embodiments, the fore curvature radius 64 may be generally the same as the aft curvature radius 65.

Figure 23A:
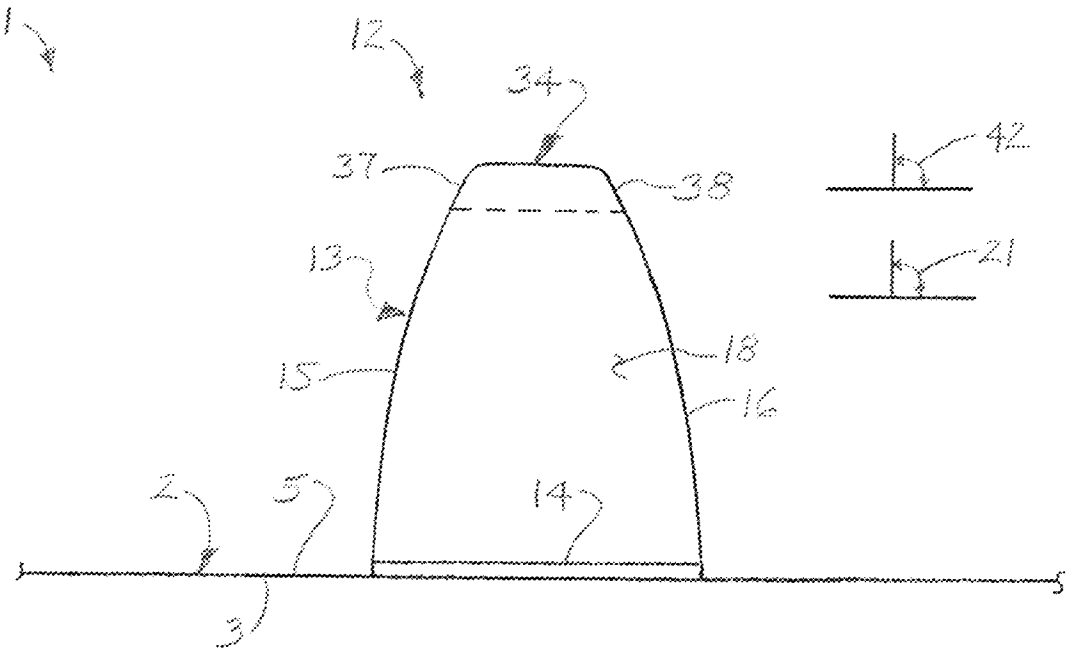
FIG. 23A is a two-dimensional planar side view of a looped blade pair of an illustrative embodiment of the enhanced performance parallel loop blade propellers in which the blade bridge has substantially the same pitch angle as that of the fore blade of the looped blade pair.
Figure 23B:
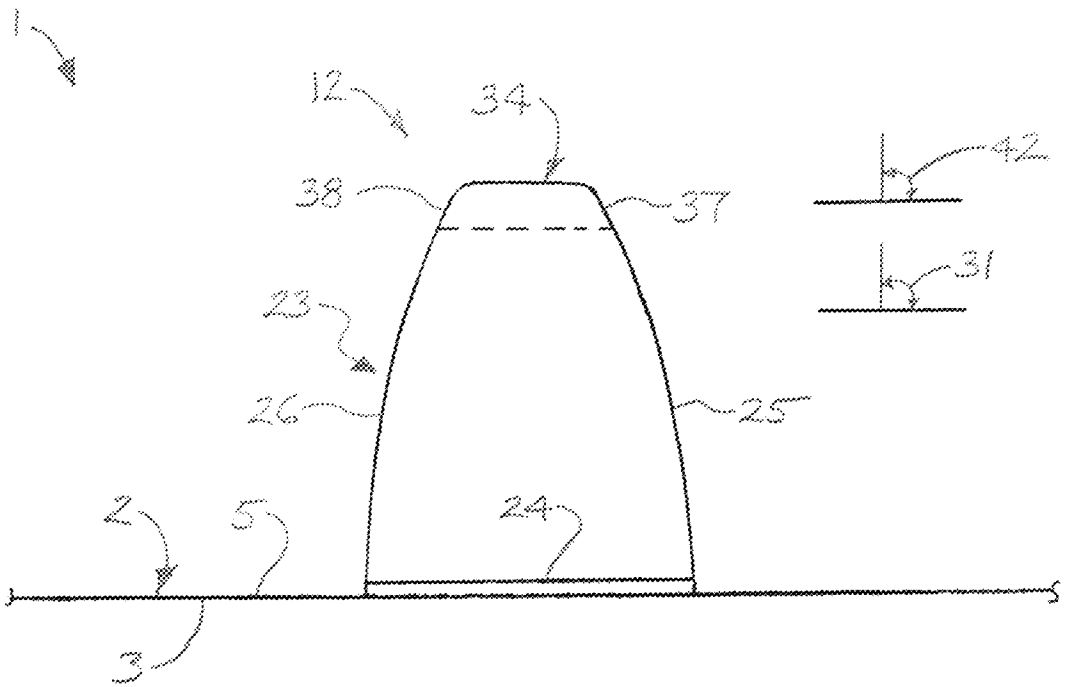
FIG. 23B is a two-dimensional planar side view of a looped blade pair of an illustrative embodiment of the enhanced performance parallel loop blade propellers in which the blade bridge has substantially the same pitch angle as that of the aft blade of the looped blade pair.

Referring next to FIGS. 23A and 23B of the drawings, in some embodiments of the propeller 1, the blade bridge 34 may have a blade bridge pitch angle 42 which may be substantially the same as the fore blade pitch angle 21 (FIG. 23A) of the fore blade 13 and/or the aft blade pitch angle 31 (FIG. 23B) of the aft blade 23 in each looped blade pair 12. In some embodiments, the blade bridge pitch angle 42 of the blade bridge 34 may be less than the fore blade pitch angle 21 of the fore blade 13 and/or the aft blade pitch angle 31 of the aft blade 23. In some embodiments, the blade bridge pitch angle 42 of the blade bridge 34 may be greater than the fore blade pitch angle 21 of the fore blade 13 and/or the aft blade pitch angle 31 of the aft blade 23. As used herein, the pitch of the propeller 1 is the distance which the propeller 1 moves forwardly or rearwardly in a single revolution.

Figure 24:
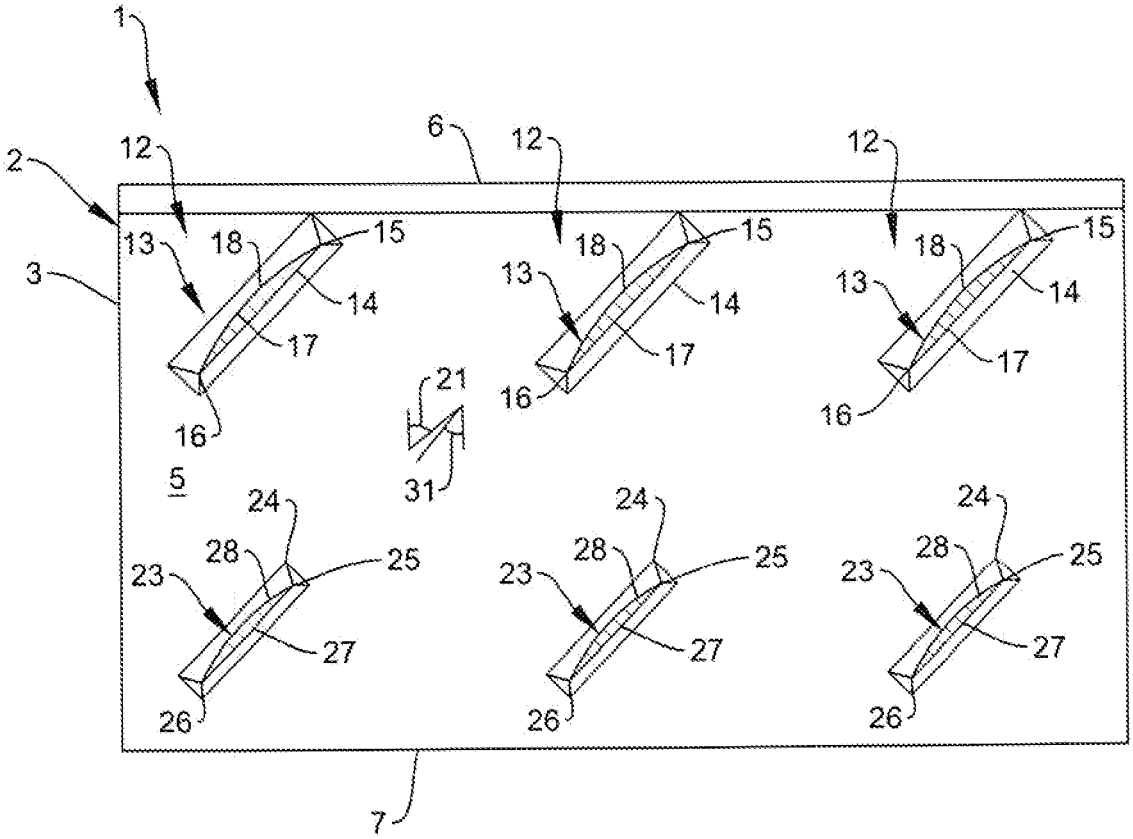
FIG. 24 is a cross-sectioned two-dimensional planar view of an illustrative propeller, such as that illustrated in FIG. 8, with the fore blade and the aft blade of each looped blade pair illustrated in cross-section and in which the aft blade has a greater pitch angle than the fore blade.

Referring next to FIG. 24 of the drawings, in some embodiments of the propeller 1, the aft blade pitch angle 31 of the aft blade 23 may be greater than the fore blade pitch angle 21 of the fore blade 13 in each looped blade pair 12. For example and without limitation, in some embodiments, the aft blade pitch angle 31 of the aft blade 23 may be about 10% greater than the fore blade pitch angle 21 of the fore blade 13 in each looped blade pair 12. In some embodiments, the aft blade pitch angle 31 may be the same as or greater than the fore blade pitch angle 21 in each looped blade pair 12.

Figure 25:
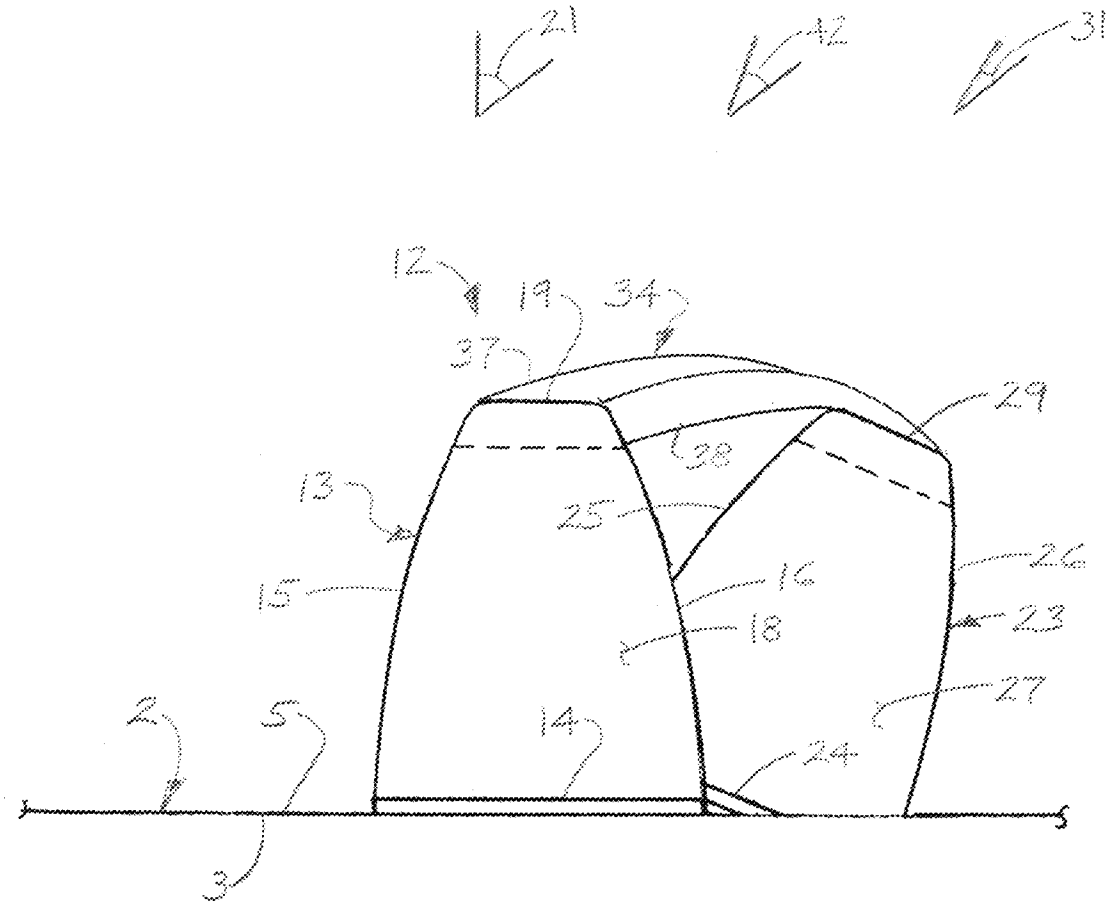
FIG. 25 is a side view of a looped blade pair of an illustrative embodiment of the enhanced performance parallel loop blade propellers in which the pitch across the fore blade, the blade bridge and the aft blade of the looped blade pair progressively change in pitch in a cambered or tail-loaded pitch profile.

Referring next to FIG. 25 of the drawings, in some embodiments of the propeller 1, each looped blade pair 12 may have a cambered or tail-loaded pitch profile. Accordingly, the fore blade pitch angle 21, the blade bridge pitch angle 42 and the aft blade pitch angle 31 may progressively change across the fore blade 13, the blade bridge 34 and the aft blade 23, respectively, of each looped blade pair 12. In some embodiments, the fore blade pitch angle 21, the blade bridge pitch angle 42 and the aft blade pitch angle 31 may progressively increase across the fore blade 13, the blade bridge 34 and the aft blade 23. In some embodiments, the fore blade pitch angle 21, the blade bridge pitch angle 42 and the aft blade pitch angle 31 may progressively decrease across the fore blade 13, the blade bridge 34 and the aft blade 23.

Referring next to FIGS. 26-32 of the drawings, in some embodiments of the propeller 1, the fore blade 13 and/or the aft blade 23 of each looped blade pair 12 may have various foil profiles. As used herein, the foil profile is the cross-sectional profile, or the profile of the fore blade 13 and/or the aft blade 23 in each looped blade pair 12 revealed as each blade is cut through the blade perpendicular to the longitudinal ais or dimension of the blade. For example and without limitation, in some embodiments, the point of maximum blade thickness in each blade may be apportioned to the proximal blade thickness 620 of the proximal blade segment 610 (the portion of the blade nearest the blade root) as compared to the middle blade thickness 621 of the middle blade segment 611 and the distal blade thickness 622 of the distal blade segment 612 (the portion of the blade nearest the blade tip) of the fore blade 13, as illustrated in FIGS. 27-29, and/or of the aft blade 23, as illustrated in FIGS. 30-32. In some embodiments, the middle blade thickness 621 of the middle blade segment 611 may be greater than the proximal blade thickness 620 of the proximal blade segment 610 and the distal blade thickness 622 of the distal blade segment 612 of the fore blade 13 and/or the aft blade 23. In some embodiments, the distal blade thickness 622 of the distal blade segment 612 may be greater than the proximal blade thickness 620 of the proximal blade segment 610 and the middle blade thickness 621 of the middle blade segment 611 of the fore blade 13 and/or the aft blade 23. In some embodiments, the blade thicknesses may be apportioned differently to the proximal blade segment 610, the middle blade segment 611 and the distal blade segment 612 of the fore blade 13 than to the proximal blade segment 610, the middle blade segment 611 and the distal blade segment 612 of the aft blade 23.

Figure 33:
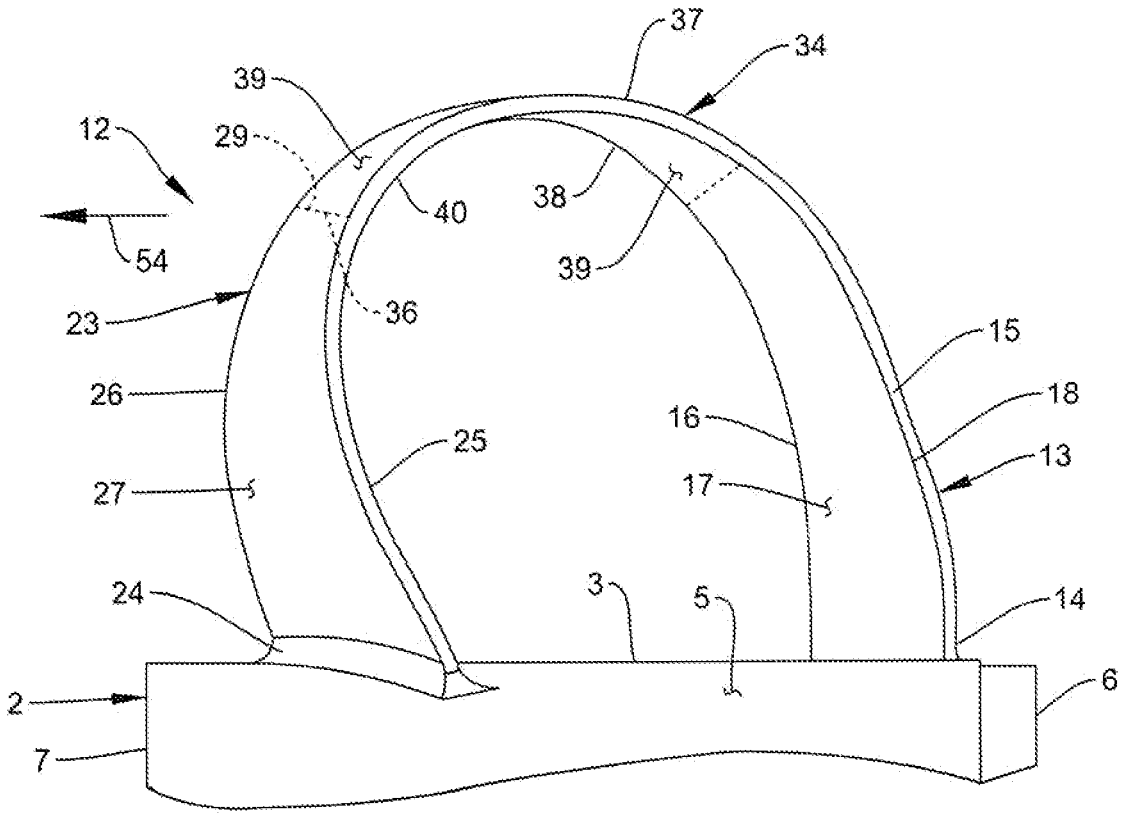
FIG. 33 is a leading blade edge perspective view of a looped blade pair of an illustrative embodiment of the enhanced performance parallel loop blade propellers in which the pressure faces of the respective fore and aft blades and the blade bridge are oriented more in the aft direction than in the fore direction of the propeller.

Referring next to FIG. 33 of the drawings, in some embodiments of the propeller 1, the fore blade pressure face 17 of the fore blade 13, the aft blade pressure face 27 of the aft blade 23 and the blade bridge pressure face 39 of the blade bridge 34 may be oriented more in the aft direction than in the fore direction of the propeller 1. This feature may increase the total magnitude of force or pressure which each looped blade pair 12 applies to the water in the water body.

Figure 35:
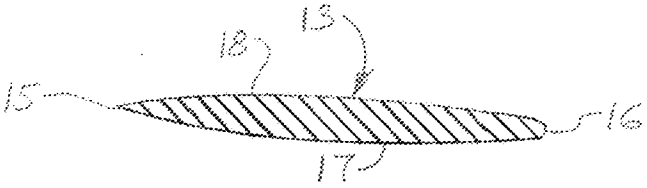
FIG. 35 is a cross-sectional view, taken along section lines 35-35 in FIG. 34, of the fore blade of the looped blade pair.
Figure 36:
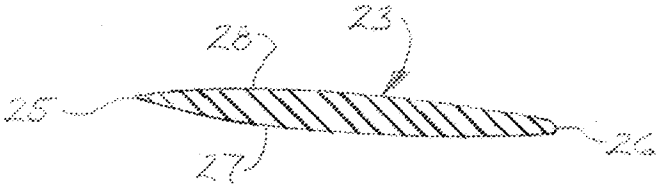
FIG. 36 is a cross-sectional view, taken along section lines 36-36 in FIG. 34, of the aft blade of the looped blade pair.
Figure 34:
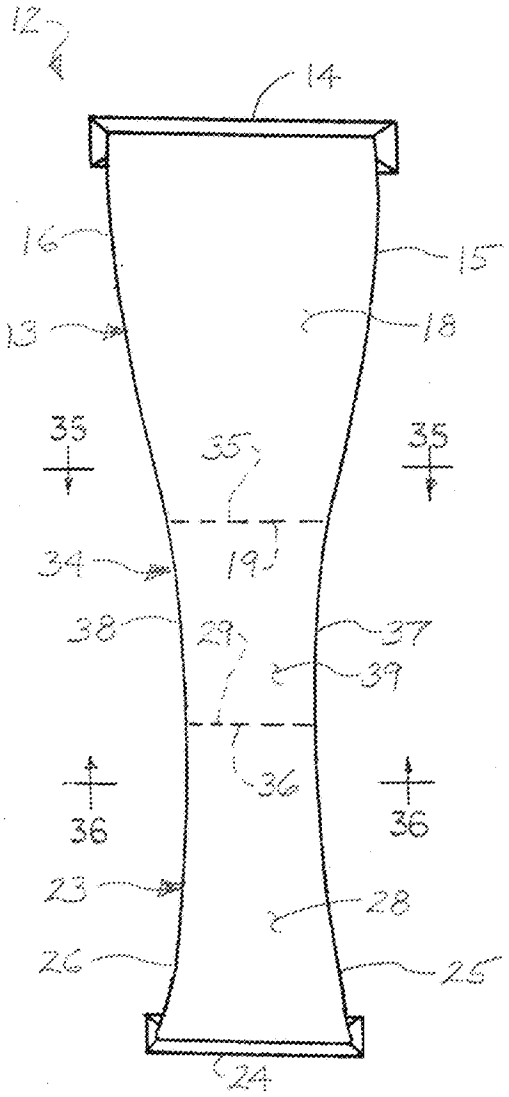
FIG. 34 is a two-dimensional planar exterior view of a looped blade pair of an illustrative embodiment of the enhanced performance parallel loop blade propellers in which each of the fore blade and the aft blade of each looped blade pair has a curved blade tip narrower on the leading blade edge than the trailing blade edge as the blade edges approach the blade tip, or the point of maximum blade diameter.

Referring next to FIGS. 34-36 of the drawings, in some embodiments of the propeller 1, the fore blade 13 of each looped blade pair 12 may have a curved fore blade tip 19 which is narrower on the leading fore blade edge 15 than on the trailing fore blade edge 16 as the leading fore blade edge 15 and the trailing fore blade edge 16 approach the point of maximum blade diameter at the terminus of the fore blade tip 19. Additionally or alternatively, in some embodiments, the aft blade 23 of each looped blade pair 12 may have a curved aft blade tip 29 which is narrower on the leading aft blade edge 25 than on the trailing aft blade edge 26 as the leading aft blade edge 25 and the trailing aft blade edge 26 approach the point of maximum blade diameter at the terminus of the aft blade tip 29. Additionally or alternatively, in some embodiments, the leading blade bridge edge 37 may be narrower than or generally equal in thickness to the trailing blade bridge edge 38 of the blade bridge 34.

Figure 38:
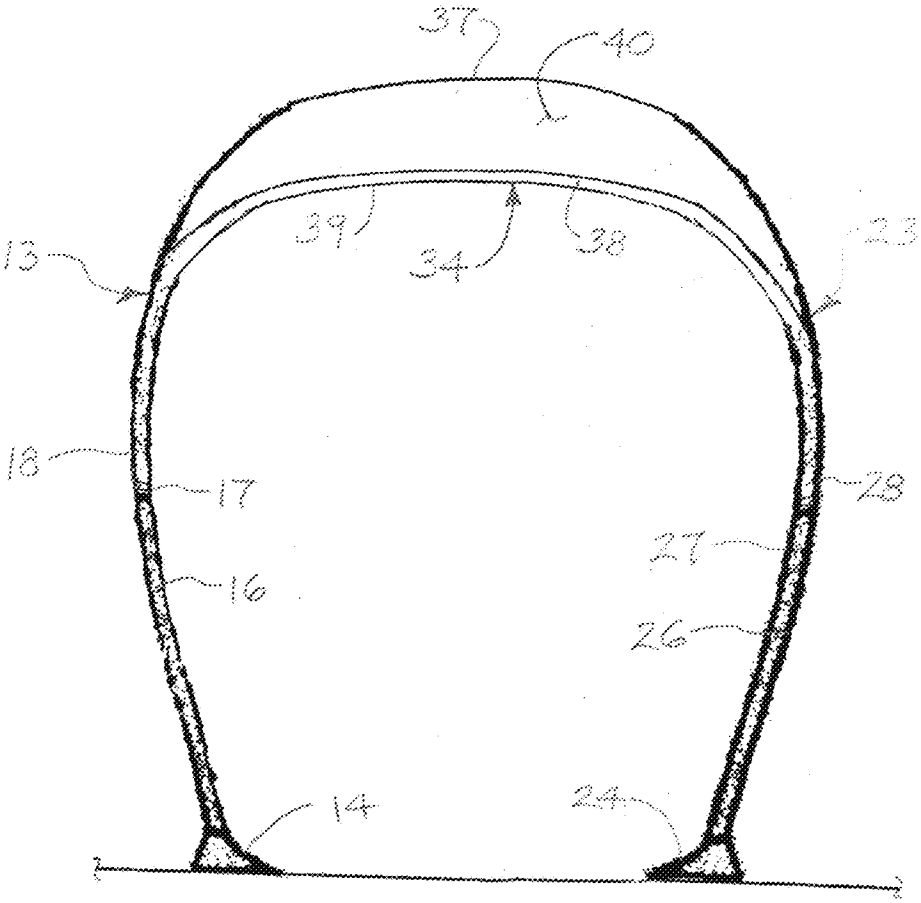
FIG. 38 is a trailing blade edge view of the looped blade pair illustrated in FIG. 37 in which each of the fore blade and the aft blade is bridged in the direction of the pitch line resulting in a monolithic bridging from the fore blade to the aft blade.
Figure 37:
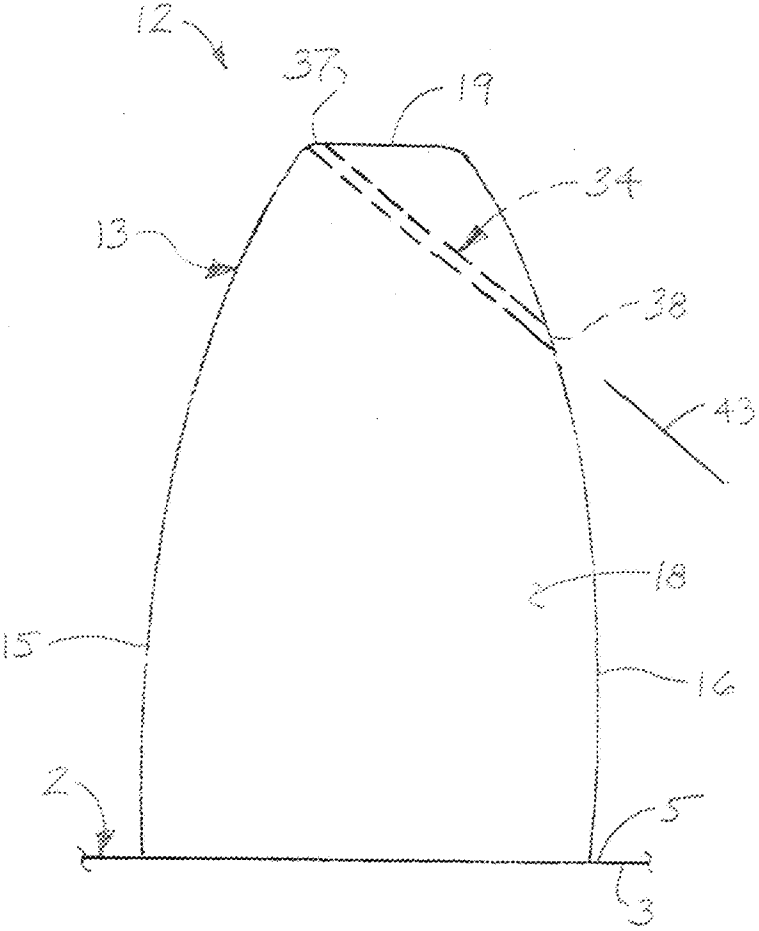
FIG. 37 is a two-dimensional side view of a looped blade pair of an illustrative embodiment of the enhanced performance parallel loop blade propellers in which the fore blade is bridged in the direction of the pitch line resulting in a monolithic bridging to the aft blade (not illustrated)

Referring next to FIGS. 37 and 38 of the drawings, in some embodiments of the propeller 1, each of the fore blade 13 and the aft blade 23 of each looped blade pair 12 may be bridged in the direction of the blade pitch line 43 of the blade bridge 34. This feature may result in a monolithic bridging of the looped blade pair 12 from the fore blade 13 to the aft blade 23.

Figure 39:
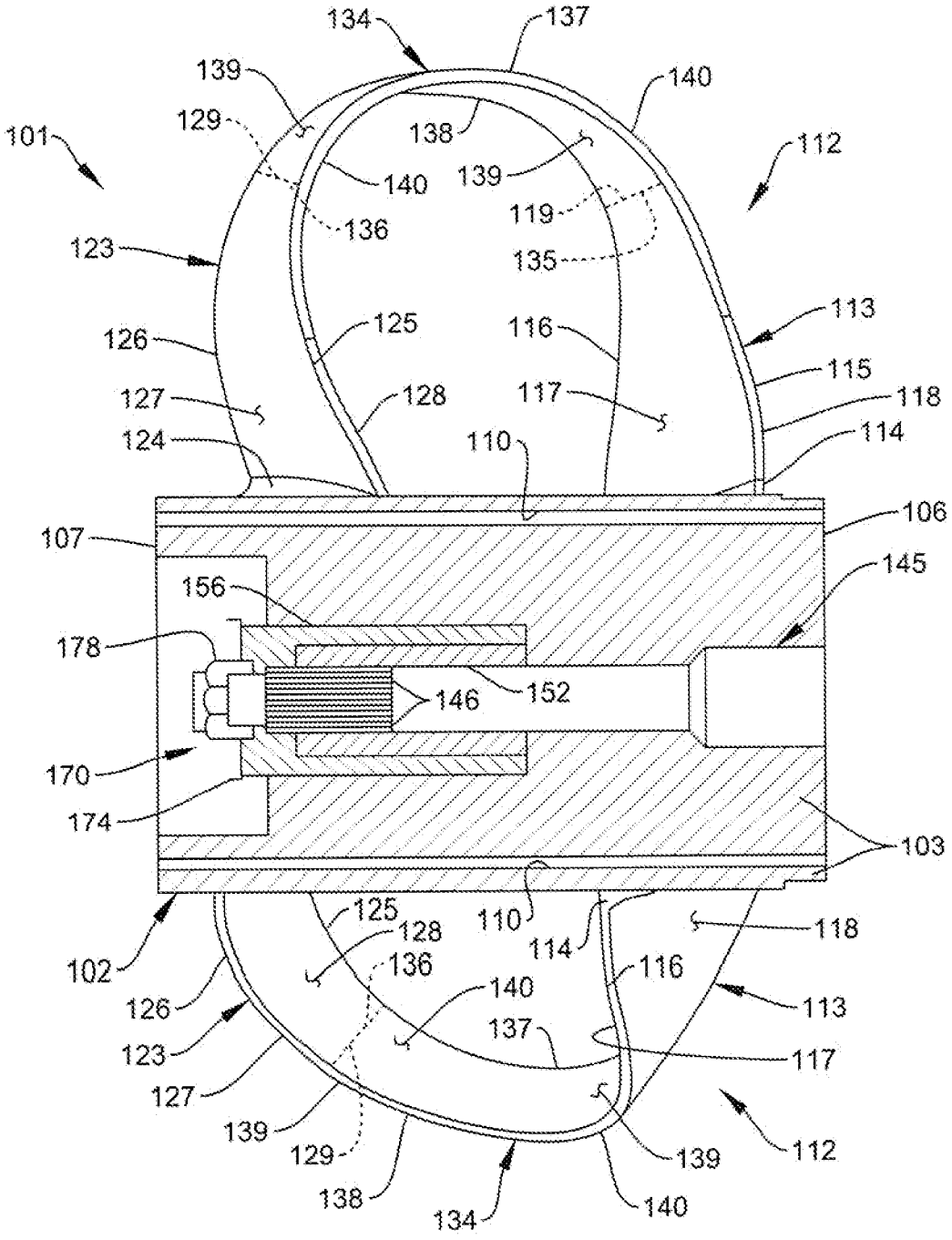
FIG. 39 is a longitudinal sectional view of the propeller hub of an alternative illustrative embodiment of the enhanced performance parallel loop blade propellers in which exhaust passageways extend longitudinally through the propeller hub of the propeller for flow of exhaust gases through the propeller hub.

Referring next to FIG. 39 of the drawings, an alternative illustrative embodiment of the enhanced performance parallel loop blade propellers is generally indicated by reference numeral 101. Unless otherwise indicated, elements of the propeller 101 which are structurally and/or functionally analogous to the respective elements of the propeller 1 that was heretofore described with respect to FIGS. 1-38 are designated by the same respective reference numerals in the 101-199 series in FIG. 39. Accordingly, to the extent which is applicable, the same descriptions and alternative embodiments which were heretofore described with respect to the propeller 1 are incorporated by reference herein in their entireties herein with respect to the propeller 101.

In the propeller 101, the propeller hub 102 may have a generally solid propeller hub wall 103 in longitudinal sectional view. At least one exhaust passageway 110 may extend through the propeller hub wall 103 from the fore hub end 106 to the aft hub end 107. In some embodiments, multiple exhaust passageways 110 may extend through the propeller hub wall 103 in a selected pattern and spacing. In some embodiments, the propeller hub wall 103 of the propeller hub 102 may have at least one hollow space 110 for weight reduction.

Application of the propeller 101 may be as was heretofore described with respect to that of the propeller 1 in FIGS. 1-38. The exhaust passageways 110 may facilitate flow of exhaust gases from the boat motor of the marine vehicle as the propeller 101 propels the marine vehicle on the water body.

Figure 40:
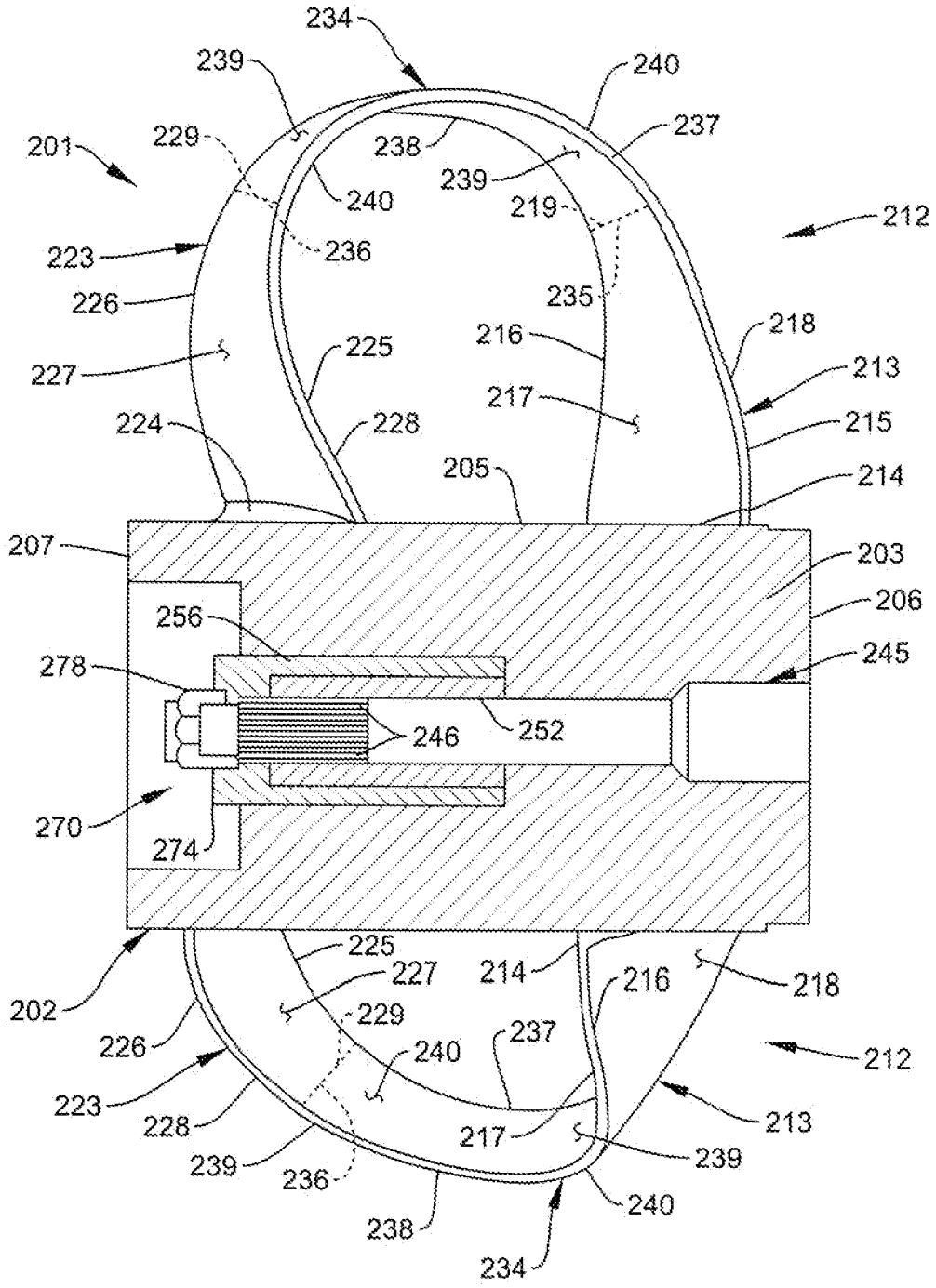
FIG. 40 is a longitudinal sectional view of an alternative illustrative embodiment of the enhanced performance parallel loop blade propellers in which the propeller hub of the propeller is generally solid and lacks exhaust passageways.

Referring next to FIG. 40 of the drawings, another alternative illustrative embodiment of the enhanced performance parallel loop blade propellers is generally indicated by reference numeral 201. Unless otherwise indicated, elements of the propeller 201 which are structurally and/or functionally analogous to the respective elements of the propeller 1 that was heretofore described with respect to FIGS. 1-38 are designated by the same respective reference numerals in the 201-299 series in FIG. 40. Accordingly, to the extent which is applicable, the same descriptions and alternative embodiments which were heretofore described with respect to the propeller 1 in FIGS. 1-38 and the propeller 101 in FIG. 39 are incorporated by reference herein in their entireties herein with respect to the propeller 201. In the propeller 201, the propeller hub 202 may have a generally solid propeller hub wall 203 without any exhaust passageways extending through the propeller hub wall 203 from the fore hub end 206 to the aft hub end 207.

Application of the propeller 201 may be as was heretofore described with respect to that of the propeller 1 in FIGS. 1-38. As the propeller 201 propels the marine vehicle on the water body, exhaust from the boat motor of the marine vehicle may be routed around the exterior propeller hub wall surface 205 of the propeller hub wall 203.

Figure 41:
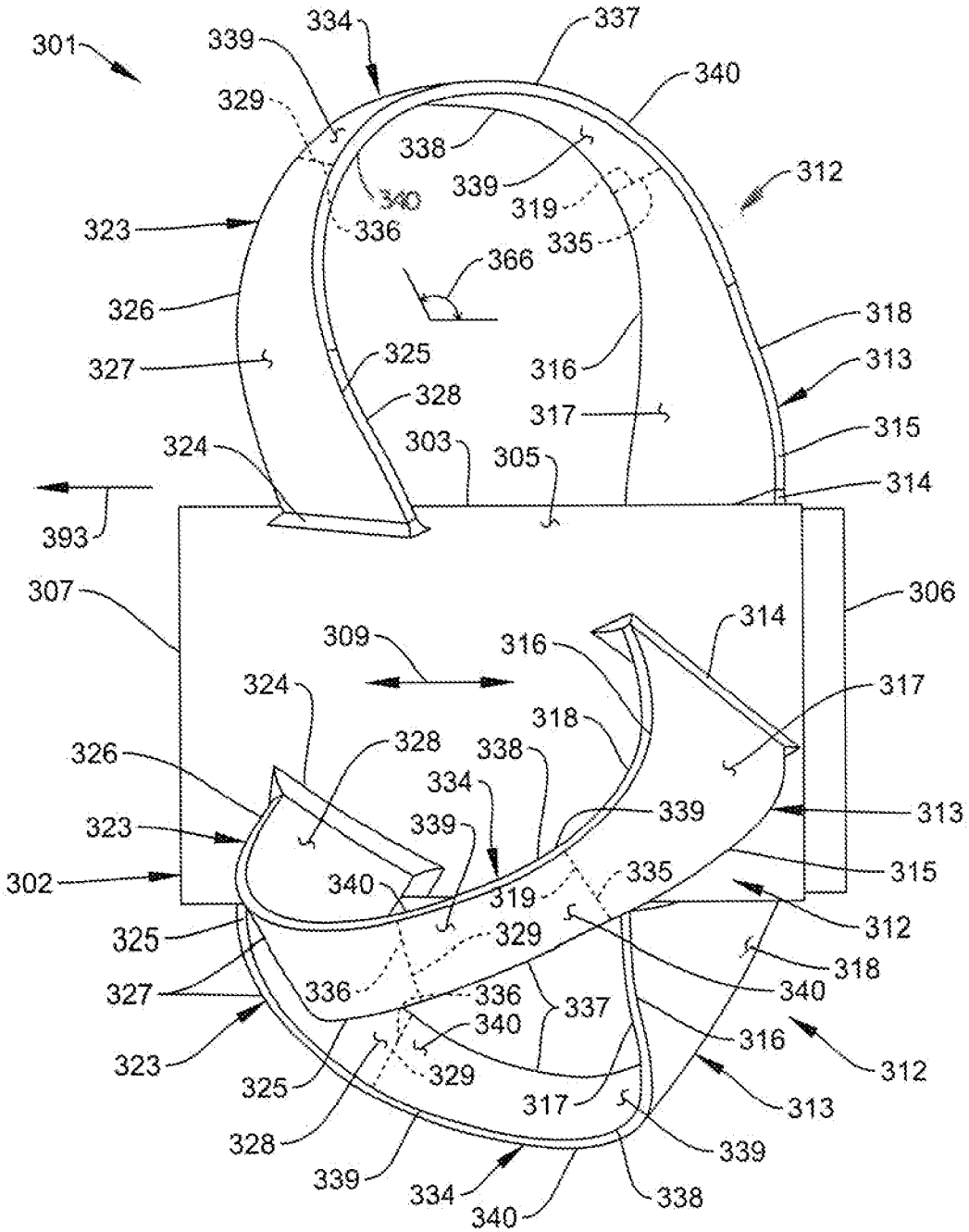
FIG. 41 is a side view of an illustrative embodiment of the enhanced performance parallel loop blade propellers in which each of the fore blade and the aft blade of each looped blade pair has a positive rake angle.

Referring next to FIG. 41 of the drawings, still another alternative illustrative embodiment of the enhanced performance parallel loop blade propellers is generally indicated by reference numeral 301. Unless otherwise indicated, elements of the propeller 301 which are structurally and/or functionally analogous to the respective elements of the propeller 1 that was heretofore described with respect to FIGS. 1-38 are designated by the same respective reference numerals in the 301-399 series in FIG. 41. Accordingly, to the extent which is applicable, the same descriptions and alternative embodiments which were heretofore described with respect to the propeller 1 in FIGS. 1-38, the propeller 101 in FIG. 39 and the propeller 201 in FIG. 40 are incorporated by reference herein in their entireties herein with respect to the propeller 301.

In the propeller 301, at least one of the fore blade 313 and the aft blade 323 in each looped blade pair 312 may have a positive blade rake angle 366. As used herein, "rake" is the angle of the fore blade pressure face 317 on the fore blade 313 and/or the angle of the aft blade pressure face 327 on the aft blade 323 relative to the longitudinal hub axis 309 of the propeller hub 302. A zero-degree rake is defined as the angle of a blade face as perpendicular to the longitudinal axis 309 of the propeller hub 302, with the blade rake angle 366 increasing as the blade face slants rearwardly toward the aft hub end 307 of the propeller hub 302. In some embodiments, the blade rake angle 366 of the fore blade 313 and/or the aft blade 323 in each looped blade pair 312 may be flat or straight. In some embodiments, the blade rake angle 366 of the fore blade 313 and/or the aft blade 323 in each looped blade pair 312 may be curved or progressive. In some embodiments, both the fore blade 313 and the aft blade 323 in each looped blade pair 312 may have the positive blade rake angle 366.

Application of the propeller 301 may be as was heretofore described with respect to that of the propeller 1 in FIGS. 1-38. In some embodiments, the positive blade rake angle 366 of the fore blade 313 and/or the aft blade 323 of each looped blade pair 312 may enhance and/or attenuate performance of the propeller 301 for various applications as the propeller 301 propels the marine vehicle on the water body.

Figure 42A:
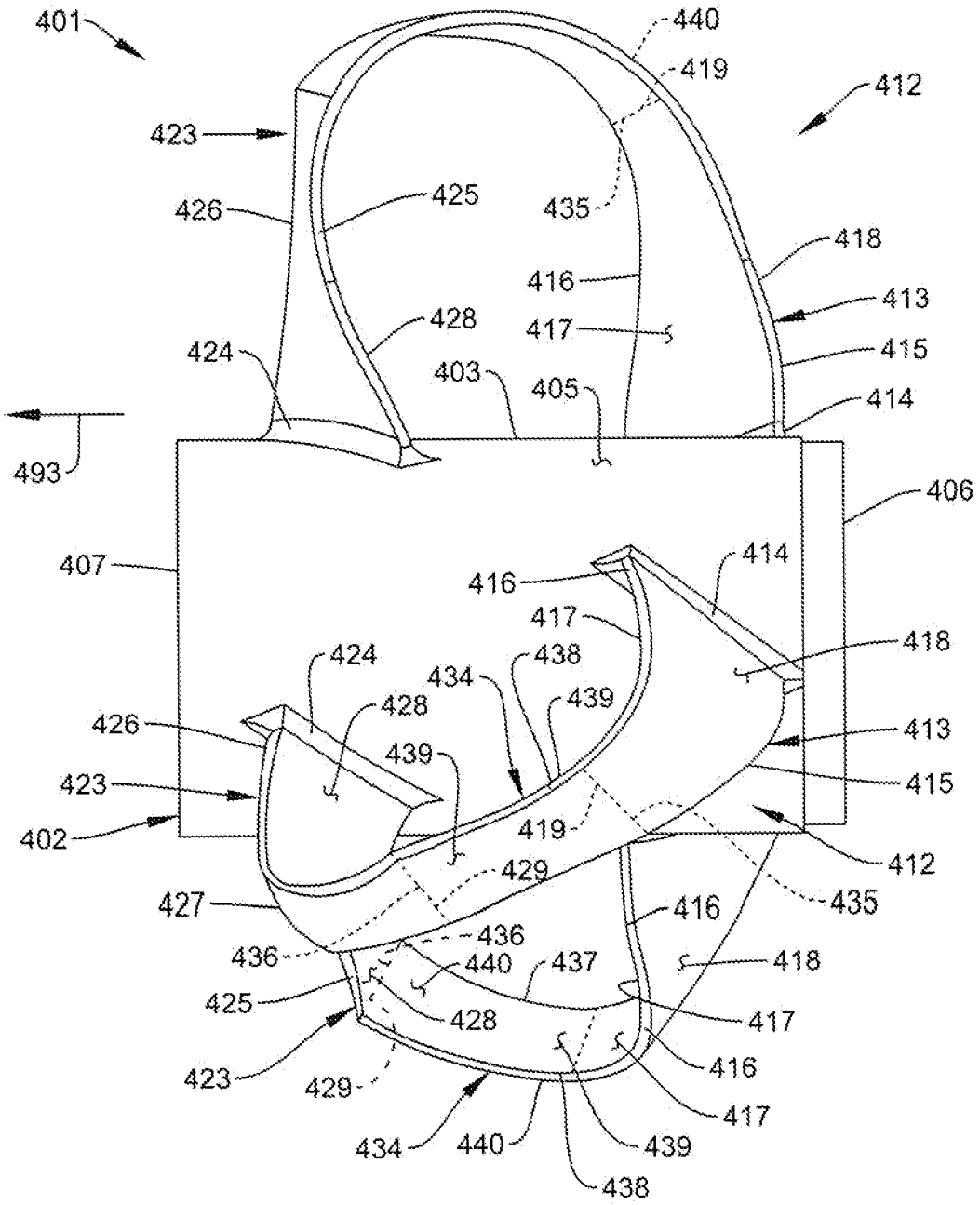
FIG. 42A is a side view of an illustrative embodiment of the enhanced performance parallel loop blade propellers in which the trailing blade edge in the aft blade of each looped blade pair has a curved, concave or cupped trailing edge.
Figure 42B:
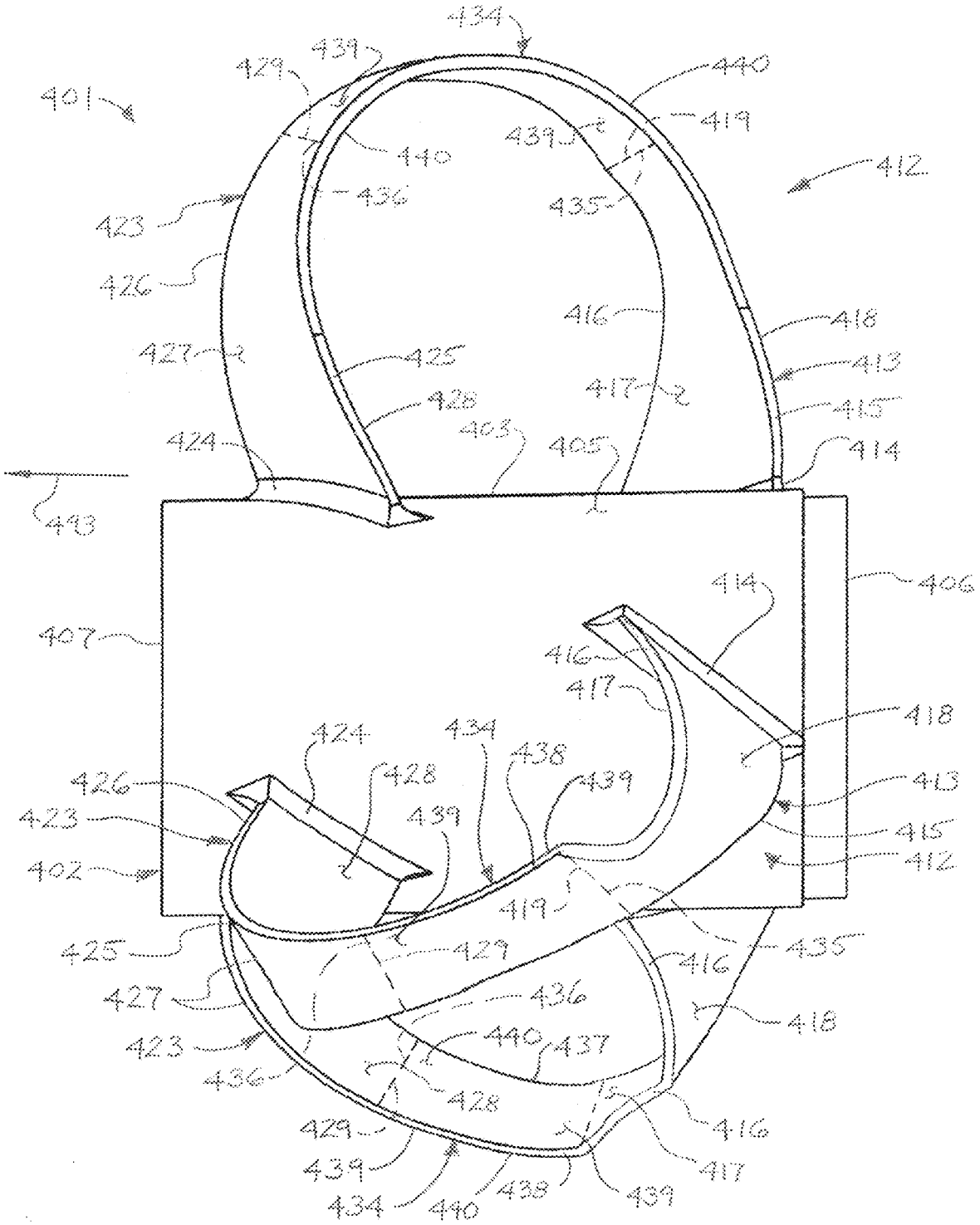
FIG. 42B is a side view of an illustrative embodiment of the enhanced performance parallel loop blade propellers in which the trailing blade edge in the fore blade of each looped blade pair has a curved, concave or cupped trailing edge.

Referring next to FIGS. 42A and 42B of the drawings, yet another alternative illustrative embodiment of the enhanced performance parallel loop blade propellers is generally indicated by reference numeral 401. Unless otherwise indicated, elements of the propeller 401 which are structurally and/or functionally analogous to the respective elements of the propeller 1 that was heretofore described with respect to FIGS. 1-38 are designated by the same respective reference numerals in the 401-499 series in FIGS. 42A and 42B. Accordingly, to the extent which is applicable, the same descriptions and alternative embodiments which were heretofore described with respect to the propeller 1 in FIGS. 1-38, the propeller 101 in FIG. 39, the propeller 201 in FIG. 40 and the propeller 301 in FIG. 41 are incorporated by reference herein in their entireties herein with respect to the propeller 401.

As illustrated in FIG. 42A, in some embodiments of the propeller 401, the trailing aft blade edge 426 in the aft blade 423 of each looped blade pair 412 may have a curved, concave or cupped trailing edge profile. Additionally or alternatively, as illustrated in FIG. 42B, in some embodiments, the trailing fore blade edge 416 in the fore blade 413 of each looped blade pair 412 may have a curved, concave or cupped trailing edge profile.

Application of the propeller 401 may be as was heretofore described with respect to that of the propeller 1 in FIGS. 1-38. The cupped trailing edge profile in the trailing aft blade edge 426 of the aft blade 423 and/or in the trailing fore blade edge 416 of the fore blade 413 in each looped blade pair 412 may enhance and/or attenuate performance of the propeller 401 for various applications as the propeller 401 propels the marine vehicle on the water body.

Figure 43:
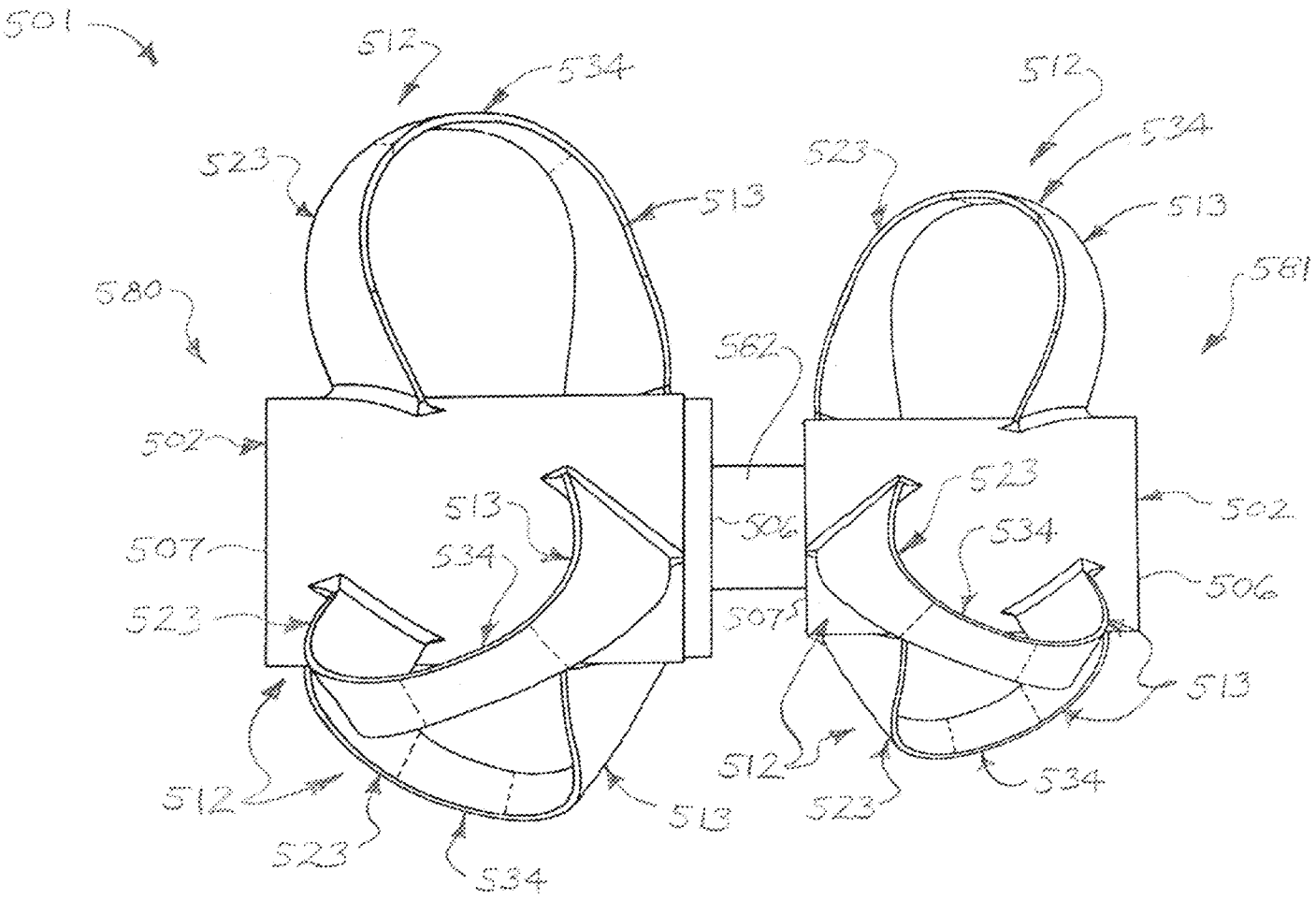
FIG. 43 is a side view of an illustrative dual prop embodiment of the enhanced performance parallel loop blade propellers.

Referring next to FIG. 43 of the drawings, a still further alternative illustrative dual prop embodiment of the enhanced performance parallel loop blade propellers is generally indicated by reference numeral 501. Unless otherwise indicated, elements of the propeller 501 which are structurally and/or functionally analogous to the respective elements of the propeller 1 that was heretofore described with respect to FIGS. 1-38 are designated by the same respective reference numerals in the 501-599 series in FIG. 43. Accordingly, to the extent which is applicable, the same descriptions and alternative embodiments which were heretofore described with respect to the propeller 1 in FIGS. 1-38, the propeller 101 in FIG. 39, the propeller 201 in FIG. 40, the propeller 301 in FIG. 41 and the propellers 401 in FIGS. 42A and 42B are incorporated by reference herein in their entireties herein with respect to the propeller 501.

The dual prop enhanced performance parallel loop propeller 501 may include a fore propeller 580 and an aft propeller 581. The propeller hub 502 and the fore blade 513 and the aft blade 523 in each looped blade pair 512 of the fore propeller 580 may be larger in diameter than the respective propeller hub 502 and the fore blade 513 and the aft blade 523 in each looped blade pair 512 of the aft propeller 581. A propeller shaft 582 may join the aft propeller 581 to the fore propeller 580. Unless otherwise noted herein, in some embodiments, the propeller 501 may have a design which is the same as or similar to those described in U.S. patent application Ser. No. 18/198,493, filed May 17, 2023, and entitled DUAL PROPELLER ASSEMBLIES AND METHODS, which patent application is hereby incorporated by reference herein in its entirety.

Each of the fore propeller 580 and the aft propeller 581 of the propeller 501 may include at least two looped blade pairs 512 which extend from the propeller hub 502 of each corresponding propeller 580, 581. The fore blade 513, the aft blade 523 and the blade bridge 534 in each looped blade pair 512 of the aft propeller 581 may be configured opposite or in mirror image to those respective components in each looped blade pair 512 of the fore propeller 580. Accordingly, the fore propeller 580 and the aft propeller 581 may be configured to counter rotate with respect to each other as the boat motor drivingly engages the fore propeller 580 and the aft propeller 581 for rotation. Application of the propeller 501 may be as was heretofore described with respect to that of the propeller 1 in FIGS. 1-38 and as described in U.S. patent application Ser. No. 18/198,493.

Figure 44:
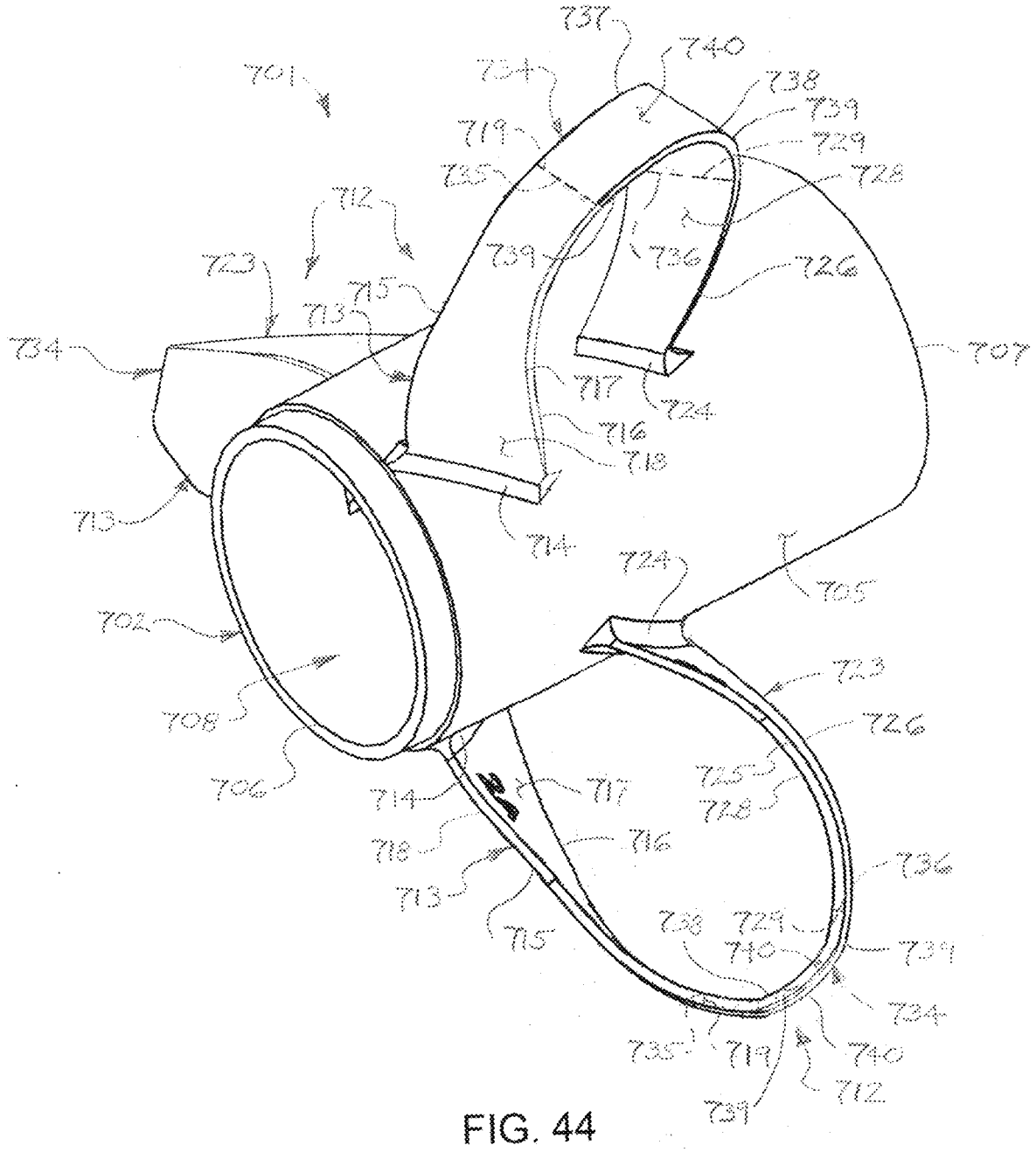
FIG. 44 is a front perspective view of another alternative illustrative embodiment of the enhanced performance parallel loop blade propellers.
Figure 45:
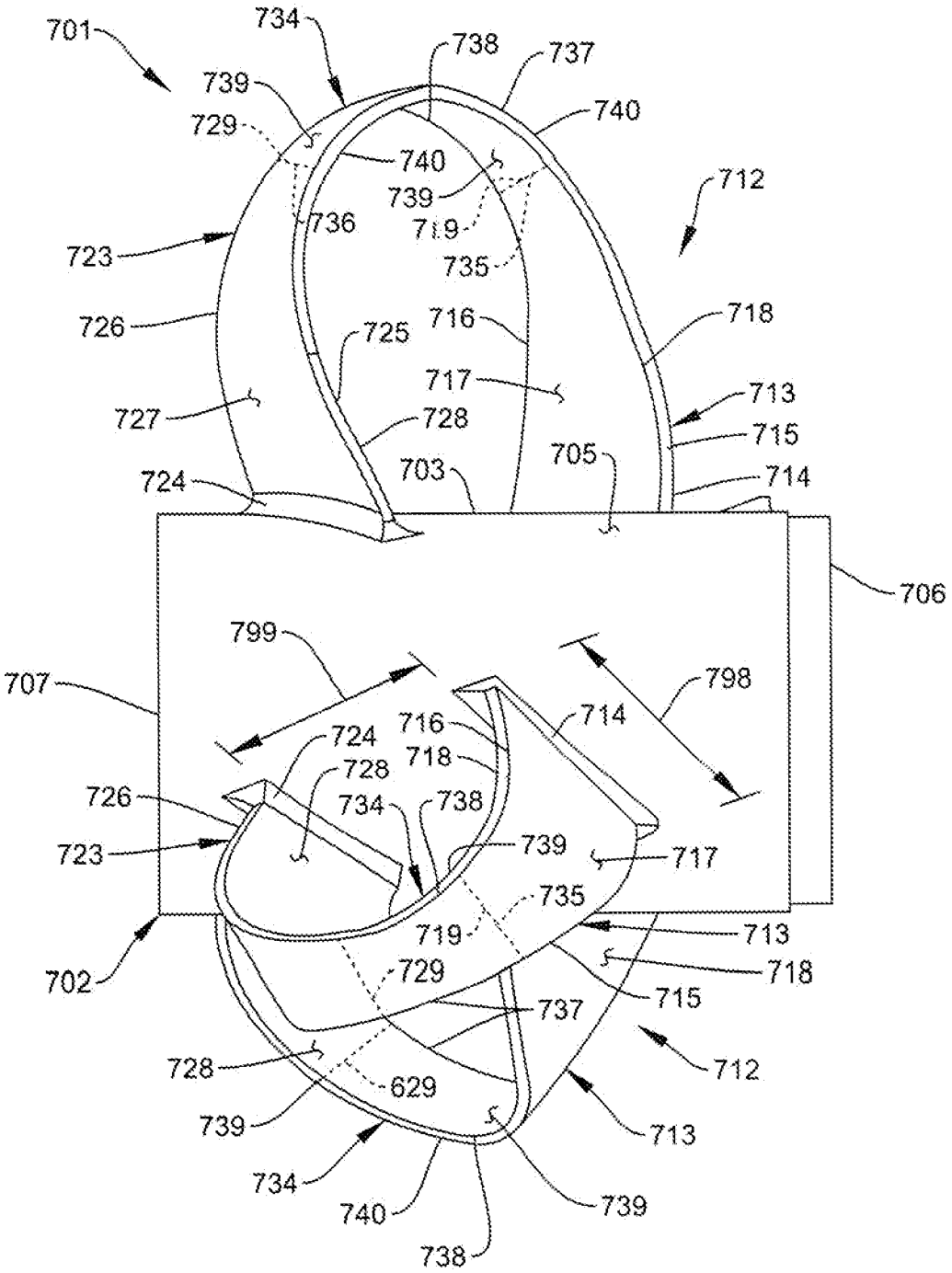
FIG. 45 is a side view of the illustrative enhanced performance parallel loop blade propeller illustrated in FIG. 44.
Figure 46:
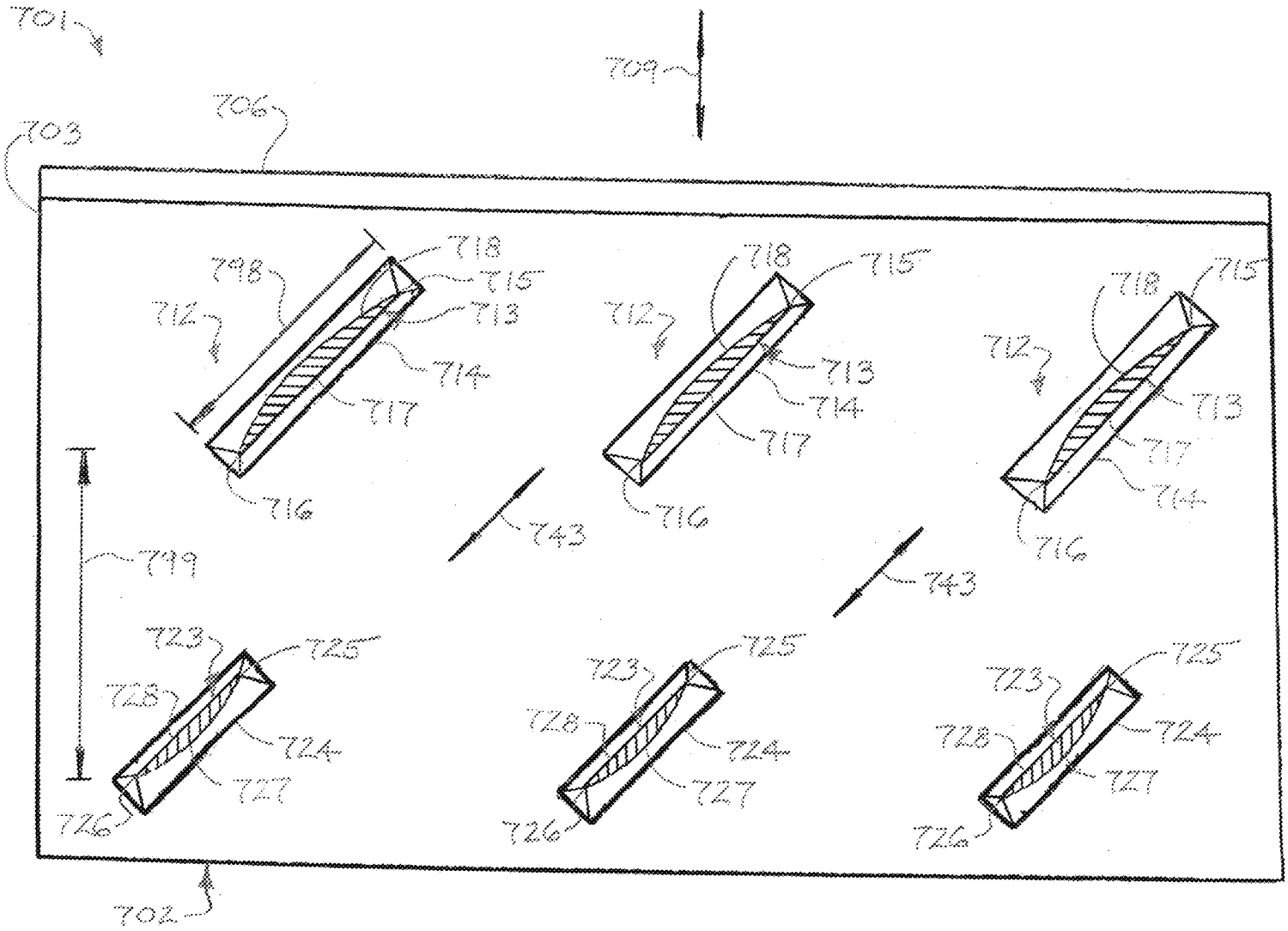
FIG. 46 is a cross-sectioned two-dimensional planar side view of the illustrative propeller illustrated in FIG. 45, with the fore blade and the aft blade of each looped blade pair illustrated in cross-section and more particularly illustrating a longitudinal blade root centerline of the aft blade of each looped blade pair intersecting the transverse blade root centerline of the fore blade of the adjacent looped blade pair.

Referring next to FIGS. 44-46 of the drawings, another alternative illustrative embodiment of the enhanced performance parallel loop blade propellers is generally indicated by reference number 701. Unless otherwise indicated, elements of the propeller 701 which are structurally and/or functionally analogous to the respective elements of the propeller 1 (FIGS. 1-38); the propeller 101 (FIG. 39); the propeller 201 (FIG. 40); the propeller 301 ((FIG. 41); the propeller 401 (FIGS. 42A and 42B); and the propeller 501 (FIG. 43) are designated by the same respective reference numbers in the 701-799 series in FIGS. 44-46. Accordingly, to the extent which is applicable, the same descriptions and alternative embodiments which were heretofore described with respect to the propellers 1, 101, 201, 301, 401 and 501 are incorporated by reference herein in their entireties with respect to the propeller 701.

As illustrated in FIGS. 45 and 46, the fore blade root 714 of the fore blade 713 in each looped blade pair 712 may have a blade root chord width 798. As illustrated in FIG. 45, the fore blade root 714 of the fore blade 713 and the aft blade root 724 of the aft blade 723 may be separated from each other by a blade root spacing distance 799. The blade root spacing distance 799 of each looped blade pair 712 may be less than or generally equal to the blade root chord width 798 of the fore blade root 714.

As further illustrated in FIG. 46, the fore blade 713 at the fore blade root 714 of each looped blade pair 712 and the aft blade 723 at the aft blade root 724 of each adjacent looped blade pair 712 may be disposed generally within a common blade pitch plane 743. In some embodiments, the pitch plane of the aft blade 723 at the aft blade root 724 may be offset toward the fore hub end 706 relative to the pitch plane of the fore blade 713 of the adjacent looped blade pair 712 at the fore blade root 714. Consequently, in the forward rotational direction 92 (FIGS. 2-5) as the looped blade pairs 712 propel the propeller 701 and the marine vehicle on a water body, water may flow first across the aft blade pressure face 727 and the aft blade suction face 728 of the aft blade 723 in each looped blade pair 712 and then directly across the fore blade suction face 718 of the fore blade 713 in the next adjacent looped blade pair 712. Having first traversed the aft blade pressure face 727 and/or the aft blade suction face 728 on the aft blade 723 of the preceding looped blade pair 712, the water may travel faster over the fore blade suction face 718 on the fore blade 713 of the next succeeding adjacent looped blade pair 712 than would otherwise be the case, thereby reducing the pressure of the water as it flows across the fore blade suction face 718, and thus, the water resistance of the fore blade 713 of that looped blade pair 712, thereby enhancing the forward propulsion of the propeller 701 in the water body.

While certain illustrative embodiments of the disclosure have been described above, it will be recognized and understood that various modifications can be made to the embodiments and the appended claims are intended to cover all such modifications which may fall within the spirit and scope of the disclosure.

I claim:

1. A marine propeller, comprising:

a propeller hub having a fore hub end, an aft hub end and a longitudinal hub axis extending through the fore hub end and the aft hub end; and a plurality of looped blade pairs extending from the propeller hub in spaced-apart relationship to each other, each of the plurality of looped blade pairs comprising:

a fore blade extending from the propeller hub proximate the fore hub end, the fore blade having a fore blade root with a fore blade root midpoint on the propeller hub;

an aft blade extending from the propeller hub proximate the aft hub end, the aft blade having an aft blade root with an aft blade root midpoint on the propeller hub, the aft blade disposed within a common blade pitch plane as the fore blade in an adjacent one of the plurality of looped blade pairs, whereby the fore blade and the aft blade of each corresponding one of the plurality of looped blade pairs are disposed in parallel relationship to each other; and a blade bridge extending from the fore blade to the aft blade; and wherein the aft blade root midpoint of the aft blade root is disposed in spaced-apart, inline relationship with respect to the fore blade root midpoint of the fore blade root along a blade root inline axis parallel to the longitudinal hub axis of the propeller hub.

2. The marine propeller of claim 1 further comprising at least one blade connecting member connecting adjacent ones of the plurality of looped blade pairs to each other on the propeller hub in a biplane blade arrangement.

3. The marine propeller of claim 1 wherein the blade bridge has a curved or arced trajectory from the fore blade the aft blade in the each corresponding one of the plurality of looped blade pairs.

4. The marine propeller of claim 1 wherein the fore blade of the each corresponding one of the plurality of looped blade pairs comprises a fore blade tip extending towards the aft blade of the each corresponding one of the plurality of looped blade pairs in a curved radius distance at least equal to a fore blade chord width of the fore blade at a last radius of the fore blade before a beginning of blade curvature.

5. The marine propeller of claim 1 wherein the fore blade has a fore blade diameter different than an aft blade diameter of the aft blade in the each corresponding one of the plurality of looped blade pairs.

6. The marine propeller of claim 5 wherein the fore blade diameter of the fore blade is greater than the aft blade diameter of the aft blade.

7. The marine propeller of claim 1 wherein the fore blade has a fore blade chord width different than an aft blade chord width of the aft blade chord at each corresponding radius of blade curvature in the each corresponding one of the plurality of looped blade pairs.

8. The marine propeller of claim 1 wherein the blade bridge in the each corresponding one of the plurality of looped blade pairs has a blade bridge chord width substantially the same as a fore blade chord width at a beginning of blade curvature of the fore blade toward the blade bridge.

9. The marine propeller of claim 1 wherein an average chord width of the each corresponding one of the plurality of looped blade pairs includes an average chord width of the fore blade, the aft blade and the blade bridge including a midpoint distance between adjacent ones of the plurality of looped blade pairs is equal to 360 degrees divided by a number of the plurality of looped blade pairs extending from the propeller hub.

10. The marine propeller of claim 1 wherein the blade bridge has a fore curvature radius different than an aft curvature radius.

11. The marine propeller of claim 1 wherein the blade bridge has a blade bridge chord width differing in cross-section with respect to a fore blade chord width of the fore blade and an aft blade chord width of the aft blade at a beginning of blade curvature of the fore blade and the aft blade, respectively.

12. The marine propeller of claim 1 wherein at least one of the fore blade and the aft blade in the each corresponding one of the plurality of looped blade pairs has a positive blade rake angle.

13. The marine propeller of claim 1 wherein a trailing aft blade edge in the aft blade of the each corresponding one of the plurality of looped blade pairs has a curved, concave or cupped trailing edge profile.

14. The marine propeller of claim 1 wherein the blade bridge has a blade bridge pitch angle substantially the same as at least one of a fore blade pitch angle of the fore blade and an aft blade pitch angle of the aft blade in the each corresponding one of the plurality of looped blade pairs.

15. The marine propeller of claim 1 wherein an aft blade pitch angle of the aft blade is greater than a fore blade pitch angle of the fore blade in the each corresponding one of the plurality of looped blade pairs.

16. The marine propeller of claim 1 wherein the propeller hub in longitudinal sectional view comprises a solid propeller hub wall without exhaust passageways.

17. The marine propeller of claim 1 wherein the propeller hub comprises a propeller hub wall with at least one hollow space for exhaust or weight reduction.

18. The marine propeller of claim 1 further comprising a fore propeller and an aft propeller configured to counter rotate with respect to each other, each of the fore propeller and the aft propeller comprising:

the propeller hub having the fore hub end and the aft hub end; and the plurality of looped blade pairs extending from the propeller hub in spaced-apart relationship to each other, each of the plurality of looped blade pairs comprising:

the fore blade extending from the propeller hub proximate the fore hub end;

the aft blade extending from the propeller hub proximate the aft hub end, the aft blade disposed within the common blade pitch plane as the fore blade in the adjacent one of the plurality of looped blade pairs, whereby the fore blade and the aft blade of the each corresponding one of the plurality of looped blade pairs are disposed in parallel relationship to each other; and the blade bridge extending from the fore blade to the aft blade.

19. The marine propeller of claim 1 wherein a fore blade pitch angle, a blade bridge pitch angle and an aft blade pitch angle progressively change across the fore blade, the blade bridge and the aft blade, respectively, of the each corresponding one of the plurality of looped blade pairs.

20. The marine propeller of claim 1 wherein a point of maximum blade thickness in each of the plurality of looped blade pairs is apportioned differently among a proximal blade thickness of a proximal blade segment, a middle blade thickness of a middle blade segment and a distal blade thickness of a distal blade segment of at least one of the fore blade and the aft blade.

21. The marine propeller of claim 1 wherein each of a fore blade pressure face of the fore blade, an aft blade pressure face of the aft blade and a blade bridge pressure face of the blade bridge 34 is oriented more in an aft direction than in a fore direction of the propeller.

22. The marine propeller of claim 1 wherein a leading fore blade edge and a trailing fore blade edge curve or taper inwardly toward each other from the fore blade root to the fore blade tip of the fore blade.

23. The marine propeller of claim 1 wherein the blade bridge is wider at a connection of the blade bridge to the fore blade than at a connection of the blade bridge to the aft blade.

24. The marine propeller of claim 1 wherein a leading blade bridge edge of the blade bridge is narrower in thickness than a trailing blade bridge edge of the blade bridge.

25. The marine propeller of claim 1 wherein each of the fore blade and the aft blade of the each corresponding one of the plurality of looped blade pairs is bridged in a direction of a blade pitch line of the blade bridge.

26. A marine propeller, comprising:

a propeller hub having a fore hub end and an aft hub end;

a plurality of looped blade pairs extending from the propeller hub in spaced-apart relationship to each other, each of the plurality of looped blade pairs comprising:

a fore blade extending from the propeller hub proximate the fore hub end;

an aft blade extending from the propeller hub proximate the aft hub end, the aft blade disposed within a common blade pitch plane as the fore blade in an adjacent one of the plurality of looped blade pairs, whereby the fore blade and the aft blade of each corresponding one of the plurality of looped blade pairs are disposed in parallel relationship to each other; and a blade bridge extending from the fore blade to the aft blade; and wherein a fore blade root of the fore blade and an aft blade root of the aft blade are separated from each other by a blade root spacing distance less than or equal to a blade root chord width of the fore blade root.

27. The marine propeller of claim 26 wherein a pitch plane of the aft blade at an aft blade root of the aft blade is offset toward the fore hub end of the propeller hub relative to a pitch plane of the fore blade of an adjacent one of the plurality of looped blade pairs at the fore blade root.

28. A marine propeller, comprising:

a fore propeller and an aft propeller configured to counter rotate with respect to each other, each of the fore propeller and the aft propeller comprising:

a propeller hub having a fore hub end and an aft hub end and a longitudinal hub axis extending through the fore hub end and the aft hub end;

a plurality of looped blade pairs extending from the propeller hub in spaced-apart relationship to each other, each of the plurality of looped blade pairs comprising:

a fore blade extending from the propeller hub proximate the fore hub end, the fore blade having a fore blade root with a fore blade root midpoint on the propeller hub;

an aft blade extending from the propeller hub proximate the aft hub end, the aft blade having an aft blade root with an aft blade root midpoint on the propeller hub and disposed within a common blade pitch plane as the fore blade in an adjacent one of the plurality of looped blade pairs, whereby the fore blade and the aft blade of each corresponding one of the plurality of looped blade pairs are disposed in parallel relationship to each other; and a blade bridge extending from the fore blade to the aft blade; and wherein a fore blade root of the fore blade and an aft blade root of the aft blade are separated from each other by a blade root spacing distance less than or equal to a blade root chord width of the fore blade root;

a blade bridge extending from the fore blade to the aft blade; and wherein the aft blade root midpoint of the aft blade root is disposed in spaced-apart, inline relationship with respect to the fore blade root midpoint of the fore blade root along a blade root inline axis parallel to the longitudinal hub axis of the propeller hub;

wherein the fore blade and the aft blade of each of the plurality of looped blade pairs has a longitudinal blade root centerline oriented along or parallel to a longitudinal axis of each of the fore blade root and the aft blade root; and wherein the fore blade and the aft blade of each of the plurality of looped blade pairs has a transverse blade root centerline oriented perpendicular to the longitudinal axis of the each of the fore blade root and the rear blade root, the longitudinal blade root centerline of the aft blade in the each of the plurality of looped blade pairs intersecting the transverse blade root centerline of the fore blade in each adjacent one of the plurality of looped blade pairs.

* * * * *